US011200839B2

(12) United States Patent
Chaji et al.

(10) Patent No.: US 11,200,839 B2
(45) **Date of Patent: *Dec. 14, 2021**

(54) SYSTEM AND METHODS FOR EXTRACTING CORRELATION CURVES FOR AN ORGANIC LIGHT EMITTING DEVICE

(71) Applicant: Ignis Innovation Inc., Waterloo (CA)

(72) Inventors: Gholamreza Chaji, Waterloo (CA); Ricky Yik Hei Ngan, Richmond Hills (CA); Nino Zahirovic, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 182 days.

This patent is subject to a terminal disclaimer.

(21) Appl. No.: 16/113,111

(22) Filed: Aug. 27, 2018

(65) Prior Publication Data

US 2018/0366060 A1 Dec. 20, 2018

Related U.S. Application Data

(63) Continuation of application No. 14/590,105, filed on Jan. 6, 2015, now Pat. No. 10,089,921, which is a (Continued)

(30) Foreign Application Priority Data

Feb. 4, 2010 (CA) ..... CA 2692097

(51) Int. Cl.
*G09G 3/3225* (2016.01)
*G09G 3/3291* (2016.01)

(52) U.S. Cl.
CPC ..... *G09G 3/3225* (2013.01); *G09G 3/3291* (2013.01); *G09G 2300/0413* (2013.01); (Continued)

(58) Field of Classification Search
CPC ..... G01G 3/3225; G01G 3/3291; G09G 2300/0413; G09G 2320/0285; (Continued)

(56) References Cited

U.S. PATENT DOCUMENTS 3,506,851 A 4/1970 Polkinghorn
3,774,055 A 11/1973 Bapat
(Continued)

FOREIGN PATENT DOCUMENTS

CA 1 294 034 1/1992
CA 2 109 951 11/1992
(Continued)

OTHER PUBLICATIONS

Ahnood: "Effect of threshold voltage instability on field effect mobility in thin film transistors deduced from constant current measurements"; dated Aug. 2009.
(Continued)

*Primary Examiner* — Jeff W Natalini
(74) *Attorney, Agent, or Firm* — Stratford Group Ltd.

(57) ABSTRACT

A system for equalizing the pixels in an array of pixels that include semiconductor devices that age differently under different ambient and stress conditions. The system extracts at least one pixel parameter from the array; creates a stress pattern for the array, based on the extracted pixel parameter; stresses the pixels in accordance with the stress pattern; extracts the pixel parameter from the stressed pixels; determines whether the pixel parameter extracted from the stressed pixels is within a preselected range and, when the answer is negative, creates a second stress pattern for the array, based on the pixel parameter extracted from the stressed pixels, stresses the pixels in accordance with the second stress pattern, extracts the pixel parameter from the stressed pixels, and determines whether the pixel parameter (Continued)

extracted from the stressed pixels is within the preselected range.

20 Claims, 13 Drawing Sheets

Related U.S. Application Data continuation-in-part of application No. 14/322,443, filed on Jul. 2, 2014, now abandoned, which is a continuation-in-part of application No. 14/314,514, filed on Jun. 25, 2014, now Pat. No. 10,176,736, which is a continuation-in-part of application No. 14/286,711, filed on May 23, 2014, now Pat. No. 9,881,532, which is a continuation-in-part of application No. 14/027,811, filed on Sep. 16, 2013, now Pat. No. 9,430,958, which is a continuation of application No. 13/020,252, filed on Feb. 3, 2011, now Pat. No. 8,589,100.

(52) U.S. Cl.
CPC ..... *G09G 2320/029* (2013.01); *G09G 2320/0285* (2013.01); *G09G 2320/043* (2013.01); *G09G 2360/145* (2013.01)

(58) Field of Classification Search
CPC ..... G09G 2320/029; G09G 2320/043; G09G 2360/145
See application file for complete search history.

(56) References Cited

U.S. PATENT DOCUMENTS

| | | | |
|---|---|---|---|
| 4,090,096 | A | 5/1978 | Nagami |
| 4,160,934 | A | 7/1979 | Kirsch |
| 4,295,091 | A | 10/1981 | Ponkala |
| 4,354,162 | A | 10/1982 | Wright |
| 4,943,956 | A | 7/1990 | Noro |
| 4,996,523 | A | 2/1991 | Bell |
| 5,153,420 | A | 10/1992 | Hack |
| 5,198,803 | A | 3/1993 | Shie |
| 5,204,661 | A | 4/1993 | Hack |
| 5,266,515 | A | 11/1993 | Robb |
| 5,489,918 | A | 2/1996 | Mosier |
| 5,498,880 | A | 3/1996 | Lee |
| 5,557,342 | A | 9/1996 | Eto |
| 5,561,381 | A | 10/1996 | Jenkins |
| 5,572,444 | A | 11/1996 | Lentz |
| 5,589,847 | A | 12/1996 | Lewis |
| 5,619,033 | A | 4/1997 | Weisfield |
| 5,648,276 | A | 7/1997 | Hara |
| 5,670,973 | A | 9/1997 | Bassetti |
| 5,684,365 | A | 11/1997 | Tang |
| 5,691,783 | A | 11/1997 | Numao |
| 5,714,968 | A | 2/1998 | Ikeda |
| 5,723,950 | A | 3/1998 | Wei |
| 5,744,824 | A | 4/1998 | Kousai |
| 5,745,660 | A | 4/1998 | Kolpatzik |
| 5,748,160 | A | 5/1998 | Shieh |
| 5,815,303 | A | 9/1998 | Berlin |
| 5,870,071 | A | 2/1999 | Kawahata |
| 5,874,803 | A | 2/1999 | Garbuzov |
| 5,880,582 | A | 3/1999 | Sawada |
| 5,903,248 | A | 5/1999 | Irwin |
| 5,917,280 | A | 6/1999 | Burrows |
| 5,923,794 | A | 7/1999 | McGrath |
| 5,945,972 | A | 8/1999 | Okumura |
| 5,949,398 | A | 9/1999 | Kim |
| 5,952,789 | A | 9/1999 | Stewart |
| 5,952,991 | A | 9/1999 | Akiyama |
| 5,982,104 | A | 11/1999 | Sasaki |
| 5,990,629 | A | 11/1999 | Yamada |
| 6,023,259 | A | 2/2000 | Howard |
| 6,069,365 | A | 5/2000 | Chow |
| 6,091,203 | A | 7/2000 | Kawashima |
| 6,097,360 | A | 8/2000 | Holloman |
| 6,144,222 | A | 11/2000 | Ho |
| 6,177,915 | B1 | 1/2001 | Beeteson |
| 6,229,506 | B1 | 5/2001 | Dawson |
| 6,229,508 | B1 | 5/2001 | Kane |
| 6,246,180 | B1 | 6/2001 | Nishigaki |
| 6,252,248 | B1 | 6/2001 | Sano |
| 6,259,424 | B1 | 7/2001 | Kurogane |
| 6,262,589 | B1 | 7/2001 | Tamukai |
| 6,271,825 | B1 | 8/2001 | Greene |
| 6,288,696 | B1 | 9/2001 | Holloman |
| 6,304,039 | B1 | 10/2001 | Appelberg |
| 6,307,322 | B1 | 10/2001 | Dawson |
| 6,310,962 | B1 | 10/2001 | Chung |
| 6,320,325 | B1 | 11/2001 | Cok |
| 6,323,631 | B1 | 11/2001 | Juang |
| 6,329,971 | B2 | 12/2001 | McKnight |
| 6,356,029 | B1 | 3/2002 | Hunter |
| 6,373,454 | B1 | 4/2002 | Knapp |
| 6,377,237 | B1 | 4/2002 | Sojourner |
| 6,392,617 | B1 | 5/2002 | Gleason |
| 6,404,139 | B1 | 6/2002 | Sasaki |
| 6,414,661 | B1 | 7/2002 | Shen |
| 6,417,825 | B1 | 7/2002 | Stewart |
| 6,433,488 | B1 | 8/2002 | Bu |
| 6,437,106 | B1 | 8/2002 | Stoner |
| 6,445,369 | B1 | 9/2002 | Yang |
| 6,475,845 | B2 | 11/2002 | Kimura |
| 6,501,098 | B2 | 12/2002 | Yamazaki |
| 6,501,466 | B1 | 12/2002 | Yamagishi |
| 6,518,962 | B2 | 2/2003 | Kimura |
| 6,522,315 | B2 | 2/2003 | Ozawa |
| 6,525,683 | B1 | 2/2003 | Gu |
| 6,531,827 | B2 | 3/2003 | Kawashima |
| 6,541,921 | B1 | 4/2003 | Luciano, Jr. |
| 6,542,138 | B1 | 4/2003 | Shannon |
| 6,555,420 | B1 | 4/2003 | Yamazaki |
| 6,577,302 | B2 | 6/2003 | Hunter |
| 6,580,408 | B1 | 6/2003 | Bae |
| 6,580,657 | B2 | 6/2003 | Sanford |
| 6,583,398 | B2 | 6/2003 | Harkin |
| 6,583,775 | B1 | 6/2003 | Sekiya |
| 6,594,606 | B2 | 7/2003 | Everitt |
| 6,618,030 | B2 | 9/2003 | Kane |
| 6,639,244 | B1 | 10/2003 | Yamazaki |
| 6,668,645 | B1 | 12/2003 | Gilmour |
| 6,677,713 | B1 | 1/2004 | Sung |
| 6,680,580 | B1 | 1/2004 | Sung |
| 6,687,266 | B1 | 2/2004 | Ma |
| 6,690,000 | B1 | 2/2004 | Muramatsu |
| 6,690,344 | B1 | 2/2004 | Takeuchi |
| 6,693,388 | B2 | 2/2004 | Oomura |
| 6,693,610 | B2 | 2/2004 | Shannon |
| 6,697,057 | B2 | 2/2004 | Koyama |
| 6,720,942 | B2 | 4/2004 | Lee |
| 6,724,151 | B2 | 4/2004 | Yoo |
| 6,734,636 | B2 | 5/2004 | Sanford |
| 6,738,034 | B2 | 5/2004 | Kaneko |
| 6,738,035 | B1 | 5/2004 | Fan |
| 6,753,655 | B2 | 6/2004 | Shih |
| 6,753,834 | B2 | 6/2004 | Mikami |
| 6,756,741 | B2 | 6/2004 | Li |
| 6,756,952 | B1 | 6/2004 | Decaux |
| 6,756,958 | B2 | 6/2004 | Furuhashi |
| 6,756,985 | B1 | 6/2004 | Hirotsune |
| 6,765,549 | B1 | 7/2004 | Yamazaki |
| 6,771,028 | B1 | 8/2004 | Winters |
| 6,777,712 | B2 | 8/2004 | Sanford |
| 6,777,888 | B2 | 8/2004 | Kondo |
| 6,781,306 | B2 | 8/2004 | Park |
| 6,781,567 | B2 | 8/2004 | Kimura |
| 6,792,157 | B1 | 9/2004 | Koshi |
| 6,806,497 | B2 | 10/2004 | Jo |
| 6,806,638 | B2 | 10/2004 | Lih |
| 6,806,857 | B2 | 10/2004 | Sempel |
| 6,809,706 | B2 | 10/2004 | Shimoda |

(56) References Cited

U.S. PATENT DOCUMENTS 6,815,975 B2 11/2004 Nara
6,828,950 B2 12/2004 Koyama
6,853,371 B2 2/2005 Miyajima
6,859,193 B1 2/2005 Yumoto
6,873,117 B2 3/2005 Ishizuka
6,876,346 B2 4/2005 Anzai
6,885,356 B2 4/2005 Hashimoto
6,900,485 B2 5/2005 Lee
6,903,734 B2 6/2005 Eu
6,909,243 B2 6/2005 Inukai
6,909,419 B2 6/2005 Zavracky
6,911,960 B1 6/2005 Yokoyama
6,911,964 B2 6/2005 Lee
6,914,448 B2 7/2005 Jinno
6,919,871 B2 7/2005 Kwon
6,924,602 B2 8/2005 Komiya
6,937,215 B2 8/2005 Lo
6,937,220 B2 8/2005 Kitaura
6,940,214 B1 9/2005 Komiya
6,943,500 B2 9/2005 LeChevalier
6,943,761 B2 9/2005 Everitt
6,947,022 B2 9/2005 McCartney
6,954,194 B2 10/2005 Matsumoto
6,956,547 B2 10/2005 Bae
6,975,142 B2 12/2005 Azami
6,975,332 B2 12/2005 Arnold
6,995,510 B2 2/2006 Murakami
6,995,519 B2 2/2006 Arnold
7,023,408 B2 4/2006 Chen
7,027,015 B2 4/2006 Booth, Jr.
7,027,078 B2 4/2006 Reihl
7,034,793 B2 4/2006 Sekiya
7,038,392 B2 5/2006 Libsch
7,053,875 B2 5/2006 Chou
7,057,359 B2 6/2006 Hung
7,061,263 B1 6/2006 Ong
7,061,451 B2 6/2006 Kimura
7,064,733 B2 6/2006 Cok
7,071,932 B2 7/2006 Libsch
7,088,051 B1 8/2006 Cok
7,088,052 B2 8/2006 Kimura
7,102,378 B2 9/2006 Kuo
7,106,285 B2 9/2006 Naugler
7,112,820 B2 9/2006 Chang
7,116,058 B2 10/2006 Lo
7,119,493 B2 10/2006 Fryer
7,122,835 B1 10/2006 Ikeda
7,127,380 B1 10/2006 Iverson
7,129,914 B2 10/2006 Knapp
7,129,938 B2 10/2006 Naugler
7,161,566 B2 1/2007 Cok
7,164,417 B2 1/2007 Cok
7,193,589 B2 3/2007 Yoshida
7,199,768 B2 4/2007 Ono
7,224,332 B2 5/2007 Cok
7,227,519 B1 6/2007 Kawase
7,245,277 B2 7/2007 Ishizuka
7,246,912 B2 7/2007 Burger
7,248,236 B2 7/2007 Nathan
7,262,753 B2 8/2007 Tanghe
7,274,363 B2 9/2007 Ishizuka
7,310,092 B2 12/2007 Imamura
7,315,295 B2 1/2008 Kimura
7,321,348 B2 1/2008 Cok
7,339,560 B2 3/2008 Sun
7,355,574 B1 4/2008 Leon
7,358,941 B2 4/2008 Ono
7,368,868 B2 5/2008 Sakamoto
7,394,195 B2 7/2008 Kato
7,397,485 B2 7/2008 Miller
7,411,571 B2 8/2008 Huh
7,414,600 B2 8/2008 Nathan
7,423,617 B2 9/2008 Giraldo
7,453,054 B2 11/2008 Lee
7,463,222 B2 12/2008 Fish
7,474,285 B2 1/2009 Kimura
7,502,000 B2 3/2009 Yuki
7,528,812 B2 5/2009 Tsuge
7,535,449 B2 5/2009 Miyazawa
7,554,512 B2 6/2009 Steer
7,569,849 B2 8/2009 Nathan
7,576,718 B2 8/2009 Miyazawa
7,580,012 B2 8/2009 Kim
7,589,707 B2 9/2009 Chou
7,605,792 B2 10/2009 Son
7,609,239 B2 10/2009 Chang
7,619,594 B2 11/2009 Hu
7,619,597 B2 11/2009 Nathan
7,633,470 B2 12/2009 Kane
7,656,370 B2 2/2010 Schneider
7,675,485 B2 3/2010 Steer
7,800,558 B2 9/2010 Routley
7,847,764 B2 12/2010 Cok
7,859,492 B2 12/2010 Kohno
7,868,859 B2 1/2011 Tomida
7,876,294 B2 1/2011 Sasaki
7,924,249 B2 4/2011 Nathan
7,932,883 B2 4/2011 Klompenhouwer
7,960,917 B2 6/2011 Kimura
7,969,390 B2 6/2011 Yoshida
7,978,187 B2 7/2011 Nathan
7,994,712 B2 8/2011 Sung
8,026,876 B2 9/2011 Nathan
8,031,180 B2 10/2011 Miyamoto
8,049,420 B2 11/2011 Tamura
8,077,123 B2 12/2011 Naugler, Jr.
8,115,707 B2 2/2012 Nathan
8,208,084 B2 6/2012 Lin
8,223,177 B2 7/2012 Nathan
8,232,939 B2 7/2012 Nathan
8,259,044 B2 9/2012 Nathan
8,264,431 B2 9/2012 Bulovic
8,279,143 B2 10/2012 Nathan
8,294,696 B2 10/2012 Min
8,299,984 B2 10/2012 Nathan
8,310,413 B2 11/2012 Fish
8,314,783 B2 11/2012 Sambandan
8,339,386 B2 12/2012 Leon
8,441,206 B2 5/2013 Myers
8,493,296 B2 7/2013 Ogawa
8,581,809 B2 11/2013 Nathan
8,589,100 B2 11/2013 Chaji
8,654,114 B2 2/2014 Shimizu
9,125,278 B2 9/2015 Nathan
9,368,063 B2 6/2016 Chaji
9,418,587 B2 8/2016 Chaji
9,430,958 B2 8/2016 Chaji
9,472,139 B2 10/2016 Nathan
9,489,891 B2 11/2016 Nathan
9,489,897 B2 11/2016 Jaffari
9,502,653 B2 11/2016 Chaji
9,530,349 B2 12/2016 Chaji
9,530,352 B2 12/2016 Nathan
9,536,460 B2 1/2017 Chaji
9,536,465 B2 1/2017 Chaji
9,589,490 B2 3/2017 Chaji
9,633,597 B2 4/2017 Nathan
9,640,112 B2 5/2017 Jaffari
9,721,512 B2 8/2017 Soni
9,741,279 B2 8/2017 Chaji
9,741,282 B2 8/2017 Giannikouris
9,761,170 B2 9/2017 Chaji
9,773,439 B2 9/2017 Chaji
9,773,441 B2 9/2017 Chaji
9,786,209 B2 10/2017 Chaji
2001/0002703 A1 6/2001 Koyama
2001/0009283 A1 7/2001 Arao
2001/0024181 A1 9/2001 Kubota
2001/0024186 A1 9/2001 Kane
2001/0026257 A1 10/2001 Kimura
2001/0030323 A1 10/2001 Ikeda
2001/0035863 A1 11/2001 Kimura
2001/0038367 A1 11/2001 Inukai
2001/0040541 A1 11/2001 Yoneda

(56) References Cited

U.S. PATENT DOCUMENTS

2001/0043173 A1 11/2001 Troutman
2001/0045929 A1 11/2001 Prache
2001/0052606 A1 12/2001 Sempel
2001/0052940 A1 12/2001 Hagihara
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai
2002/0018034 A1 2/2002 Ohki
2002/0030190 A1 3/2002 Ohtani
2002/0047565 A1 4/2002 Nara
2002/0052086 A1 5/2002 Maeda
2002/0067134 A1 6/2002 Kawashima
2002/0084463 A1 7/2002 Sanford
2002/0101152 A1 8/2002 Kimura
2002/0101172 A1 8/2002 Bu
2002/0105279 A1 8/2002 Kimura
2002/0117722 A1 8/2002 Osada
2002/0122308 A1 9/2002 Ikeda
2002/0158587 A1 10/2002 Komiya
2002/0158666 A1 10/2002 Azami
2002/0158823 A1 10/2002 Zavracky
2002/0167471 A1 11/2002 Everitt
2002/0167474 A1 11/2002 Everitt
2002/0169575 A1 11/2002 Everitt
2002/0180369 A1 12/2002 Koyama
2002/0180721 A1 12/2002 Kimura
2002/0181276 A1 12/2002 Yamazaki
2002/0183945 A1 12/2002 Everitt
2002/0186214 A1 12/2002 Siwinski
2002/0190924 A1 12/2002 Asano
2002/0190971 A1 12/2002 Nakamura
2002/0195967 A1 12/2002 Kim
2002/0195968 A1 12/2002 Sanford
2003/0020413 A1 1/2003 Oomura
2003/0030603 A1 2/2003 Shimoda
2003/0043088 A1 3/2003 Booth
2003/0057895 A1 3/2003 Kimura
2003/0058226 A1 3/2003 Bertram
2003/0062524 A1 4/2003 Kimura
2003/0063081 A1 4/2003 Kimura
2003/0071821 A1 4/2003 Sundahl
2003/0076048 A1 4/2003 Rutherford
2003/0090447 A1 5/2003 Kimura
2003/0090481 A1 5/2003 Kimura
2003/0107560 A1 6/2003 Yumoto
2003/0111966 A1 6/2003 Mikami
2003/0122745 A1 7/2003 Miyazawa
2003/0122749 A1 7/2003 Booth, Jr.
2003/0122813 A1 7/2003 Ishizuki
2003/0142088 A1 7/2003 LeChevalier
2003/0146897 A1 8/2003 Hunter
2003/0151569 A1 8/2003 Lee
2003/0156101 A1 8/2003 Le Chevalier
2003/0169241 A1 9/2003 LeChevalier
2003/0174152 A1 9/2003 Noguchi
2003/0179626 A1 9/2003 Sanford
2003/0185438 A1 10/2003 Osawa
2003/0197663 A1 10/2003 Lee
2003/0210256 A1 11/2003 Mori
2003/0230141 A1 12/2003 Gilmour
2003/0230980 A1 12/2003 Forrest
2003/0231148 A1 12/2003 Lin
2004/0032382 A1 2/2004 Cok
2004/0036457 A1 2/2004 Tokioka
2004/0036708 A1 2/2004 Evanicky
2004/0041750 A1 3/2004 Abe
2004/0051469 A1 3/2004 Ha
2004/0066357 A1 4/2004 Kawasaki
2004/0070557 A1 4/2004 Asano
2004/0070565 A1 4/2004 Nayar
2004/0090186 A1 5/2004 Kanauchi
2004/0090400 A1 5/2004 Yoo
2004/0095297 A1 5/2004 Libsch
2004/0100427 A1 5/2004 Miyazawa
2004/0108518 A1 6/2004 Jo
2004/0135749 A1 7/2004 Kondakov
2004/0140982 A1 7/2004 Pate
2004/0145547 A1 7/2004 Oh
2004/0150592 A1 8/2004 Mizukoshi
2004/0150594 A1 8/2004 Koyama
2004/0150595 A1 8/2004 Kasai
2004/0155841 A1 8/2004 Kasai
2004/0174347 A1 9/2004 Sun
2004/0174349 A1 9/2004 Libsch
2004/0174354 A1 9/2004 Ono
2004/0178743 A1 9/2004 Miller
2004/0178974 A1 9/2004 Miller
2004/0183759 A1 9/2004 Stevenson
2004/0196275 A1 10/2004 Hattori
2004/0207615 A1 10/2004 Yumoto
2004/0227697 A1 11/2004 Mori
2004/0233125 A1 11/2004 Tanghe
2004/0239596 A1 12/2004 Ono
2004/0246246 A1 12/2004 Tobita
2004/0252089 A1 12/2004 Ono
2004/0257313 A1 12/2004 Kawashima
2004/0257353 A1 12/2004 Imamura
2004/0257355 A1 12/2004 Naugler
2004/0263437 A1 12/2004 Hattori
2004/0263444 A1 12/2004 Kimura
2004/0263445 A1 12/2004 Inukai
2004/0263541 A1 12/2004 Takeuchi
2005/0007355 A1 1/2005 Miura
2005/0007357 A1 1/2005 Yamashita
2005/0007392 A1 1/2005 Kasai
2005/0017650 A1 1/2005 Fryer
2005/0024081 A1 2/2005 Kuo
2005/0024393 A1 2/2005 Kondo
2005/0030267 A1 2/2005 Tanghe
2005/0057484 A1 3/2005 Diefenbaugh
2005/0057580 A1 3/2005 Yamano
2005/0067943 A1 3/2005 Sakaguchi
2005/0067970 A1 3/2005 Libsch
2005/0067971 A1 3/2005 Kane
2005/0068270 A1 3/2005 Awakura
2005/0068275 A1 3/2005 Kane
2005/0073264 A1 4/2005 Matsumoto
2005/0083323 A1 4/2005 Suzuki
2005/0088103 A1 4/2005 Kageyama
2005/0105031 A1 5/2005 Shih
2005/0110420 A1 5/2005 Arnold
2005/0110807 A1 5/2005 Chang
2005/0122294 A1 6/2005 Ben-David
2005/0140598 A1 6/2005 Kim
2005/0140610 A1 6/2005 Smith
2005/0145891 A1 7/2005 Abe
2005/0156831 A1 7/2005 Yamazaki
2005/0162079 A1 7/2005 Sakamoto
2005/0168416 A1 8/2005 Hashimoto
2005/0179626 A1 8/2005 Yuki
2005/0179628 A1 8/2005 Kimura
2005/0185200 A1 8/2005 Tobol
2005/0190610 A1 9/2005 Furukawa
2005/0200575 A1 9/2005 Kim
2005/0206590 A1 9/2005 Sasaki
2005/0212787 A1 9/2005 Noguchi
2005/0219184 A1 10/2005 Zehner
2005/0225683 A1 10/2005 Nozawa
2005/0248515 A1 11/2005 Naugler
2005/0269959 A1 12/2005 Uchino
2005/0269960 A1 12/2005 Ono
2005/0280615 A1 12/2005 Cok
2005/0280766 A1 12/2005 Johnson
2005/0285822 A1 12/2005 Reddy
2005/0285825 A1 12/2005 Eom
2006/0001613 A1 1/2006 Routley
2006/0007072 A1 1/2006 Choi
2006/0007206 A1 1/2006 Reddy
2006/0007249 A1 1/2006 Reddy
2006/0012310 A1 1/2006 Chen
2006/0012311 A1 1/2006 Ogawa
2006/0015272 A1 1/2006 Giraldo

(56) References Cited

U.S. PATENT DOCUMENTS

| | | | |
|---|---|---|---|
| 2006/0022204 | A1 | 2/2006 | Steer |
| 2006/0022305 | A1 | 2/2006 | Yamashita |
| 2006/0022907 | A1 | 2/2006 | Uchino |
| 2006/0027807 | A1 | 2/2006 | Nathan |
| 2006/0030084 | A1 | 2/2006 | Young |
| 2006/0038501 | A1 | 2/2006 | Koyama |
| 2006/0038758 | A1 | 2/2006 | Routley |
| 2006/0038762 | A1 | 2/2006 | Chou |
| 2006/0044227 | A1 | 3/2006 | Hadcock |
| 2006/0061248 | A1 | 3/2006 | Cok |
| 2006/0063281 | A1 | 3/2006 | Cok |
| 2006/0066533 | A1 | 3/2006 | Sato |
| 2006/0007713 | A1 | 4/2006 | Cok |
| 2006/0077134 | A1 | 4/2006 | Hector |
| 2006/0077136 | A1 | 4/2006 | Cok |
| 2006/0077142 | A1 | 4/2006 | Kwon |
| 2006/0082523 | A1 | 4/2006 | Guo |
| 2006/0092185 | A1 | 5/2006 | Jo |
| 2006/0097628 | A1 | 5/2006 | Suh |
| 2006/0097631 | A1 | 5/2006 | Lee |
| 2006/0103324 | A1 | 5/2006 | Kim |
| 2006/0103611 | A1 | 5/2006 | Choi |
| 2006/0125740 | A1 | 6/2006 | Shirasaki |
| 2006/0132634 | A1 | 6/2006 | Kudoh |
| 2006/0149493 | A1 | 7/2006 | Sambandan |
| 2006/0170623 | A1 | 8/2006 | Naugler, Jr. |
| 2006/0176250 | A1 | 8/2006 | Nathan |
| 2006/0208961 | A1 | 9/2006 | Nathan |
| 2006/0208971 | A1 | 9/2006 | Deane |
| 2006/0214888 | A1 | 9/2006 | Schneider |
| 2006/0231740 | A1 | 10/2006 | Kasai |
| 2006/0232522 | A1 | 10/2006 | Roy |
| 2006/0244697 | A1 | 11/2006 | Lee |
| 2006/0256048 | A1 | 11/2006 | Fish |
| 2006/0261841 | A1 | 11/2006 | Fish |
| 2006/0273997 | A1 | 12/2006 | Nathan |
| 2006/0279481 | A1 | 12/2006 | Haruna |
| 2006/0284801 | A1 | 12/2006 | Yoon |
| 2006/0284802 | A1 | 12/2006 | Kohno |
| 2006/0284895 | A1 | 12/2006 | Maren |
| 2006/0290614 | A1 | 12/2006 | Nathan |
| 2006/0290618 | A1 | 12/2006 | Goto |
| 2007/0001937 | A1 | 1/2007 | Park |
| 2007/0001939 | A1 | 1/2007 | Hashimoto |
| 2007/0008251 | A1 | 1/2007 | Kohno |
| 2007/0008268 | A1 | 1/2007 | Park |
| 2007/0008297 | A1 | 1/2007 | Bassetti |
| 2007/0057873 | A1 | 3/2007 | Uchino |
| 2007/0057874 | A1 | 3/2007 | Le Roy |
| 2007/0069998 | A1 | 3/2007 | Naugler |
| 2007/0075727 | A1 | 4/2007 | Nakano |
| 2007/0076226 | A1 | 4/2007 | Klompenhouwer |
| 2007/0080905 | A1 | 4/2007 | Takahara |
| 2007/0080906 | A1 | 4/2007 | Tanabe |
| 2007/0080908 | A1 | 4/2007 | Nathan |
| 2007/0097038 | A1 | 5/2007 | Yamazaki |
| 2007/0097041 | A1 | 5/2007 | Park |
| 2007/0103411 | A1 | 5/2007 | Cok |
| 2007/0103419 | A1 | 5/2007 | Uchino |
| 2007/0115221 | A1 | 5/2007 | Buchhauser |
| 2007/0126672 | A1 | 6/2007 | Tada |
| 2007/0164664 | A1 | 7/2007 | Ludwicki |
| 2007/0164937 | A1 | 7/2007 | Jung |
| 2007/0164938 | A1 | 7/2007 | Shin |
| 2007/0164959 | A1 | 7/2007 | Childs |
| 2007/0182671 | A1 | 8/2007 | Nathan |
| 2007/0195020 | A1 | 8/2007 | Nathan |
| 2007/0236134 | A1 | 10/2007 | Ho |
| 2007/0236440 | A1 | 10/2007 | Wacyk |
| 2007/0236517 | A1 | 10/2007 | Kimpe |
| 2007/0241999 | A1 | 10/2007 | Lin |
| 2007/0273294 | A1 | 11/2007 | Nagayama |
| 2007/0285359 | A1 | 12/2007 | Ono |
| 2007/0290957 | A1 | 12/2007 | Cok |
| 2007/0290958 | A1 | 12/2007 | Cok |
| 2007/0296672 | A1 | 12/2007 | Kim |
| 2008/0001525 | A1 | 1/2008 | Chao |
| 2008/0001544 | A1 | 1/2008 | Murakami |
| 2008/0012804 | A1 | 1/2008 | Kim |
| 2008/0024694 | A1 | 1/2008 | Kondo |
| 2008/0030518 | A1 | 2/2008 | Higgins |
| 2008/0036706 | A1 | 2/2008 | Kitazawa |
| 2008/0036708 | A1 | 2/2008 | Shirasaki |
| 2008/0042942 | A1 | 2/2008 | Takahashi |
| 2008/0042948 | A1 | 2/2008 | Yamashita |
| 2008/0048951 | A1 | 2/2008 | Naugler, Jr. |
| 2008/0055209 | A1 | 3/2008 | Cok |
| 2008/0055211 | A1 | 3/2008 | Ogawa |
| 2008/0074413 | A1 | 3/2008 | Ogura |
| 2008/0088549 | A1 | 4/2008 | Nathan |
| 2008/0088648 | A1 | 4/2008 | Nathan |
| 2008/0111766 | A1 | 5/2008 | Uchino |
| 2008/0116787 | A1 | 5/2008 | Hsu |
| 2008/0117144 | A1 | 5/2008 | Nakano et al. |
| 2008/0136770 | A1 | 6/2008 | Peker |
| 2008/0150845 | A1 | 6/2008 | Ishii |
| 2008/0150847 | A1 | 6/2008 | Kim |
| 2008/0158115 | A1 | 7/2008 | Cordes |
| 2008/0158648 | A1 | 7/2008 | Cummings |
| 2008/0170004 | A1 | 7/2008 | Jung |
| 2008/0174335 | A1 | 7/2008 | Maekawa |
| 2008/0191976 | A1 | 8/2008 | Nathan |
| 2008/0198103 | A1 | 8/2008 | Toyomura |
| 2008/0211749 | A1 | 9/2008 | Weitbruch |
| 2008/0218451 | A1 | 9/2008 | Miyamoto |
| 2008/0225183 | A1 | 9/2008 | Tomizawa |
| 2008/0231558 | A1 | 9/2008 | Naugler |
| 2008/0231562 | A1 | 9/2008 | Kwon |
| 2008/0231625 | A1 | 9/2008 | Minami |
| 2008/0246713 | A1 | 10/2008 | Lee |
| 2008/0252223 | A1 | 10/2008 | Toyoda |
| 2008/0252571 | A1 | 10/2008 | Hente |
| 2008/0259020 | A1 | 10/2008 | Fisekovic |
| 2008/0284768 | A1 | 11/2008 | Yoshida et al. |
| 2008/0290805 | A1 | 11/2008 | Yamada |
| 2008/0297055 | A1 | 12/2008 | Miyake |
| 2009/0015532 | A1 | 1/2009 | Katayama |
| 2009/0033598 | A1 | 2/2009 | Suh |
| 2009/0058772 | A1 | 3/2009 | Lee |
| 2009/0109142 | A1 | 4/2009 | Takahara |
| 2009/0121994 | A1 | 5/2009 | Miyata |
| 2009/0146926 | A1 | 6/2009 | Sung |
| 2009/0160743 | A1 | 6/2009 | Tomida |
| 2009/0174628 | A1 | 7/2009 | Wang |
| 2009/0184901 | A1 | 7/2009 | Kwon |
| 2009/0195483 | A1 | 8/2009 | Naugler, Jr. |
| 2009/0201281 | A1 | 8/2009 | Routley |
| 2009/0206764 | A1 | 8/2009 | Schemmann |
| 2009/0207160 | A1 | 8/2009 | Shirasaki |
| 2009/0213046 | A1 | 8/2009 | Nam |
| 2009/0244046 | A1 | 10/2009 | Seto |
| 2009/0262047 | A1 | 10/2009 | Yamashita |
| 2009/0309503 | A1 | 12/2009 | Kim |
| 2010/0004891 | A1 | 1/2010 | Ahlers |
| 2010/0026725 | A1 | 2/2010 | Smith |
| 2010/0033469 | A1 | 2/2010 | Nathan |
| 2010/0039422 | A1 | 2/2010 | Seto |
| 2010/0039458 | A1 | 2/2010 | Nathan |
| 2010/0045646 | A1 | 2/2010 | Kishi |
| 2010/0045650 | A1 | 2/2010 | Fish |
| 2010/0060911 | A1 | 3/2010 | Marcu |
| 2010/0073335 | A1 | 3/2010 | Min |
| 2010/0073357 | A1 | 3/2010 | Min |
| 2010/0079419 | A1 | 4/2010 | Shibusawa |
| 2010/0085282 | A1 | 4/2010 | Yu |
| 2010/0103160 | A1 | 4/2010 | Jeon |
| 2010/0103203 | A1 | 4/2010 | Choi |
| 2010/0134469 | A1 | 6/2010 | Ogura |
| 2010/0134475 | A1 | 6/2010 | Ogura |
| 2010/0165002 | A1 | 7/2010 | Ahn |
| 2010/0176746 | A1 | 7/2010 | Catalano |
| 2010/0188320 | A1 | 7/2010 | Min |
| 2010/0194670 | A1 | 8/2010 | Cok |
| 2010/0207960 | A1 | 8/2010 | Kimpe |

(56) References Cited

U.S. PATENT DOCUMENTS

| | | | | |
|---|---|---|---|---|
| 2010/0225630 | A1 | 9/2010 | Levey | |
| 2010/0251295 | A1 | 9/2010 | Amento | |
| 2010/0277400 | A1 | 11/2010 | Jeong | |
| 2010/0315319 | A1 | 12/2010 | Cok | |
| 2011/0032232 | A1 | 2/2011 | Smith | |
| 2011/0050870 | A1 | 3/2011 | Hanari | |
| 2011/0063197 | A1 | 3/2011 | Chung | |
| 2011/0069051 | A1 | 3/2011 | Nakamura | |
| 2011/0069089 | A1 | 3/2011 | Kopf | |
| 2011/0069094 | A1 | 3/2011 | Knapp | |
| 2011/0069096 | A1 | 3/2011 | Li | |
| 2011/0074750 | A1 | 3/2011 | Leon | |
| 2011/0074762 | A1 | 3/2011 | Shirasaki | |
| 2011/0109610 | A1 | 5/2011 | Yamamoto | |
| 2011/0149166 | A1 | 6/2011 | Botzas | |
| 2011/0169798 | A1 | 7/2011 | Lee | |
| 2011/0175895 | A1 | 7/2011 | Hayakawa | |
| 2011/0181630 | A1 | 7/2011 | Smith | |
| 2011/0191042 | A1 | 8/2011 | Chaji | |
| 2011/0199395 | A1 | 8/2011 | Nathan | |
| 2011/0227964 | A1 | 9/2011 | Chaji | |
| 2011/0242074 | A1 | 10/2011 | Bert | |
| 2011/0273399 | A1 | 11/2011 | Lee | |
| 2011/0279488 | A1 | 11/2011 | Nathan | |
| 2011/0292006 | A1 | 12/2011 | Kim | |
| 2011/0293480 | A1 | 12/2011 | Mueller | |
| 2012/0044232 | A1 | 2/2012 | Yamada | |
| 2012/0044272 | A1 | 2/2012 | Han | |
| 2012/0056558 | A1 | 3/2012 | Toshiya | |
| 2012/0062565 | A1 | 3/2012 | Fuchs | |
| 2012/0082464 | A1 | 4/2012 | Yasuda | |
| 2012/0262184 | A1 | 10/2012 | Shen | |
| 2012/0299970 | A1 | 11/2012 | Bae | |
| 2012/0299973 | A1 | 11/2012 | Jaffari | |
| 2012/0299978 | A1 | 11/2012 | Chaji | |
| 2013/0000273 | A1 | 1/2013 | Nathan | |
| 2013/0002527 | A1 | 1/2013 | Kim | |
| 2013/0057595 | A1 | 3/2013 | Nathan | |
| 2013/0112960 | A1 | 5/2013 | Chaji | |
| 2013/0135272 | A1 | 5/2013 | Park | |
| 2013/0162617 | A1 | 6/2013 | Yoon | |
| 2013/0201223 | A1 | 8/2013 | Li | |
| 2013/0241813 | A1 | 9/2013 | Tanaka | |
| 2013/0309821 | A1 | 11/2013 | Yoo | |
| 2013/0321671 | A1 | 12/2013 | Cote | |
| 2014/0015824 | A1 | 1/2014 | Chaji | |
| 2014/0022289 | A1 | 1/2014 | Lee | |
| 2014/0043316 | A1 | 2/2014 | Chaji | |
| 2014/0055500 | A1 | 2/2014 | Lai | |
| 2014/0111567 | A1 | 4/2014 | Nathan | |
| 2014/0176403 | A1* | 6/2014 | Inoue | G09G 3/3208 345/77 |
| 2015/0366016 | A1 | 12/2015 | Kitamura | |
| 2016/0005342 | A1* | 1/2016 | Park | G09G 3/3208 345/207 |
| 2016/0275860 | A1 | 9/2016 | Wu | |
| 2017/0011674 | A1 | 1/2017 | Chaji | |

FOREIGN PATENT DOCUMENTS

| | | | |
|---|---|---|---|
| CA | 2 249 592 | | 7/1998 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 438 577 | | 8/2002 |
| CA | 2 463 653 | | 1/2004 |
| CA | 2 498 136 | | 3/2004 |
| CA | 2 522 396 | | 11/2004 |
| CA | 2 443 206 | | 3/2005 |
| CA | 2 472 671 | | 12/2005 |
| CA | 2 567 076 | | 1/2006 |
| CA | 2526436 | | 2/2006 |
| CA | 2 526 782 | | 4/2006 |
| CA | 2 541 531 | | 7/2006 |
| CA | 2 550 102 | | 4/2008 |
| CA | 2 773 699 | | 10/2013 |
| CN | 1381032 | | 11/2002 |
| CN | 1448908 | | 10/2003 |
| CN | 1538377 | A | 10/2004 |
| CN | 1623180 | A | 6/2005 |
| CN | 1682267 | A | 10/2005 |
| CN | 1758309 | A | 4/2006 |
| CN | 1760945 | | 4/2006 |
| CN | 1886774 | | 12/2006 |
| CN | 1897093 | A | 7/2007 |
| CN | 100375141 | C | 3/2008 |
| CN | 101164377 | A | 4/2008 |
| CN | 101194300 | A | 6/2008 |
| CN | 101300618 | A | 11/2008 |
| CN | 101315742 | A | 12/2008 |
| CN | 101449311 | | 6/2009 |
| CN | 101477783 | A | 7/2009 |
| CN | 101615376 | | 12/2009 |
| CN | 101763838 | A | 1/2010 |
| CN | 101923828 | A | 12/2010 |
| CN | 102187679 | A | 9/2011 |
| CN | 102414737 | A | 4/2012 |
| CN | 102656621 | | 9/2012 |
| CN | 102725786 | A | 10/2012 |
| CN | 102741910 | A | 10/2012 |
| CN | 103051917 | A | 4/2013 |
| CN | 103280162 | A | 9/2013 |
| EP | 0 158 366 | | 10/1985 |
| EP | 1 028 471 | | 8/2000 |
| EP | 1 111577 | | 6/2001 |
| EP | 1 130 565 | A1 | 9/2001 |
| EP | 1 194 013 | | 4/2002 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 145 0341 | A | 8/2004 |
| EP | 1 465 143 | A | 10/2004 |
| EP | 1 469 448 | A | 10/2004 |
| EP | 1 521 203 | A2 | 4/2005 |
| EP | 1 594 347 | | 11/2005 |
| EP | 1 784 055 | A2 | 5/2007 |
| EP | 1854338 | A1 | 11/2007 |
| EP | 1 879 169 | A1 | 1/2008 |
| EP | 1 879 172 | A1 | 1/2008 |
| EP | 2395499 | A1 | 12/2011 |
| GB | 2 389 951 | | 12/2003 |
| JP | 1272298 | | 10/1989 |
| JP | 4-042619 | | 2/1992 |
| JP | 6-314977 | | 11/1994 |
| JP | 8-340243 | | 12/1996 |
| JP | 09-090405 | | 4/1997 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-81607 | | 3/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-229513 | | 8/2002 |
| JP | 2002-278513 | | 9/2002 |
| JP | 2002-333862 | | 11/2002 |
| JP | 2003-076331 | | 3/2003 |
| JP | 2003-124519 | | 4/2003 |
| JP | 2003-177709 | | 6/2003 |
| JP | 2003-271095 | | 9/2003 |
| JP | 2003-308046 | | 10/2003 |
| JP | 2003-317944 | | 11/2003 |
| JP | 2004-004675 | | 1/2004 |
| JP | 2004-045648 | | 2/2004 |

(56) References Cited

FOREIGN PATENT DOCUMENTS

| | | | |
|---|---|---|---|
| JP | 2004-145197 | | 5/2004 |
| JP | 2004-287345 | | 10/2004 |
| JP | 2005-057217 | | 3/2005 |
| JP | 2006-284970 | A | 10/2006 |
| JP | 2007-065015 | | 3/2007 |
| JP | 2007-155754 | | 6/2007 |
| JP | 2007-163712 | A | 6/2007 |
| JP | 2007-206590 | A | 8/2007 |
| JP | 2008-102335 | | 5/2008 |
| JP | 4-158570 | | 10/2008 |
| JP | 2009-265621 | A | 11/2009 |
| JP | 2013-506168 | A | 2/2013 |
| JP | 2003-195813 | | 7/2013 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 1221268 | | 9/2004 |
| TW | 1223092 | | 11/2004 |
| TW | I 248321 | A | 1/2006 |
| TW | 200727247 | | 7/2007 |
| WO | WO 1998/48403 | | 10/1998 |
| WO | WO 1999/48079 | | 9/1999 |
| WO | WO 2001/06484 | | 1/2001 |
| WO | WO 2001/27910 | A1 | 4/2001 |
| WO | WO 2001/63587 | A2 | 8/2001 |
| WO | WO 2002/067327 | A | 8/2002 |
| WO | WO 2003/001496 | A1 | 1/2003 |
| WO | WO 2003/034389 | A | 4/2003 |
| WO | WO 2003/058594 | A1 | 7/2003 |
| WO | WO 2003/063124 | | 7/2003 |
| WO | WO 2003/077231 | | 9/2003 |
| WO | WO 2004/003877 | | 1/2004 |
| WO | WO 2004/025615 | A | 3/2004 |
| WO | WO 2004/034364 | | 4/2004 |
| WO | WO 2004/047058 | | 6/2004 |
| WO | WO 2004/066249 | A1 | 8/2004 |
| WO | WO 2004/104975 | A1 | 12/2004 |
| WO | WO 2005/022498 | | 3/2005 |
| WO | WO 2005/022500 | A | 3/2005 |
| WO | WO 2005/029455 | | 3/2005 |
| WO | WO 2005/029456 | | 3/2005 |
| WO | WO/2005/034072 | A1 | 4/2005 |
| WO | WO 2005/055185 | | 6/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2007/003877 | A | 1/2007 |
| WO | WO 2007/079572 | | 7/2007 |
| WO | WO 2007/090287 | A1 | 8/2007 |
| WO | WO 2007/120849 | A2 | 10/2007 |
| WO | WO 2009/048618 | | 4/2009 |
| WO | WO 2009/055920 | | 5/2009 |
| WO | WO 2009/127065 | | 10/2009 |
| WO | WO 2010/023270 | | 3/2010 |
| WO | WO 2010/146707 | A1 | 12/2010 |
| WO | WO 2011/041224 | A1 | 4/2011 |
| WO | WO 2011/064761 | A1 | 6/2011 |
| WO | WO 2011/067729 | | 6/2011 |
| WO | WO 2012/160424 | A1 | 11/2012 |
| WO | WO 2012/160471 | | 11/2012 |
| WO | WO 2012/164474 | A2 | 12/2012 |
| WO | WO 2012/164475 | A2 | 12/2012 |

OTHER PUBLICATIONS

Alexander: "Pixel circuits and drive schemes for glass and elastic AMOLED displays"; dated Jul. 2005 (9 pages).
Alexander: "Unique Electrical Measurements Technology for Compensation Inspection and Process Diagnostics of AMOLED HDTV"; dated May 2010 (4 pages).
Ashtiani: "AMOLED Pixel Circuit With Electronic Compensation of Luminance Degradation"; dated Mar. 2007 (4 pages).
Chaji: "A Current-Mode Comparator for Digital Calibration of Amorphous Silicon AMOLED Displays"; dated Jul. 2008 (5 pages).
Chaji: "A fast settling current driver based on the CCII for AMOLED displays"; dated Dec. 2009 (6 pages).
Chaji: "A Low-Cost Stable Amorphous Silicon AMOLED Display with Full V~T- and V~O~L~E~D Shift Compensation"; dated May 2007 (4 pages).
Chaji: "A low-power driving scheme for a-Si:H active-matrix organic light-emitting diode displays"; dated Jun. 2005 (4 pages).
Chaji: "A low-power high-performance digital circuit for deep submicron technologies"; dated Jun. 2005 (4 pages).
Chaji: "A novel a-Si:H AMOLED pixel circuit based on short-term stress stability of a-Si:H TFTs"; dated Oct. 2005 (3 pages).
Chaji: "A Novel Driving Scheme and Pixel Circuit for AMOLED Displays"; dated Jun. 2006 (4 pages).
Chaji: "A Novel Driving Scheme for High Resolution Large-area a-Si:H AMOLED displays"; dated Aug. 2005 (3 pages).
Chaji: "A Stable Voltage-Programmed Pixel Circuit for a-Si:H AMOLED Displays"; dated Dec. 2006 (12 pages).
Chaji: "A Sub-μA fast-settling current-programmed pixel circuit for AMOLED displays"; dated Sep. 2007.
Chaji: "An Enhanced and Simplified Optical Feedback Pixel Circuit for AMOLED Displays"; dated Oct. 2006.
Chaji: "Compensation technique for DC and transient instability of thin film transistor circuits for large-area devices"; dated Aug. 2008.
Chaji: "Driving scheme for stable operation of 2-TFT a-Si AMOLED pixel"; dated Apr. 2005 (2 pages).
Chaji: "Dynamic-effect compensation technique for stable a-Si:H AMOLED displays"; dated Aug. 2005 (4 pages).
Chaji: "Electrical Compensation of OLED Luminance Degradation"; dated Dec. 2007 (3 pages).
Chaji: "eUTDSP: a design study of a new VLIW-based DSP architecture"; dated May 2003 (4 pages).
Chaji: "Fast and Offset-Leakage Insensitive Current-Mode Line Driver for Active Matrix Displays and Sensors"; dated Feb. 2009 (8 pages).
Chaji: "High Speed Low Power Adder Design With A New Logic Style: Pseudo Dynamic Logic (SDL)"; dated Oct. 2001 (4 pages).
Chaji: "High-precision fast current source for large-area current-programmed a-Si flat panels"; dated Sep. 2006 (4 pages).
Chaji: "Low-Cost AMOLED Television with IGNIS Compensating Technolgy"; dated May 2008 (4 pages).
Chaji: "Low-Cost Stable a-Si:H AMOLED Display for Portable Applications"; dated Jun. 2006 (4 pages).
Chaji: "Low-Power Low-Cost Volatage-Programmed a-Si:H AMOLED Display"; dated Jun. 2008 (5 pages).
Chaji: "Merged phototransistor pixel with enhance near infrared response and flicker noise reduction for biomolecular imaging"; dated Nov. 2008 (3 pages).
Chaji: "Parallel Addressing Scheme for Voltage-Programmed Active-Matrix OLED Displays"; dated May 2007 (6 pages).
Chaji: "Psuedo dynamic logic (SDL): a high-speed and low-power dynamic logic family"; dated 2002 (4 pages).
Chaji: "Stabel a-Si:H circuits based on short-term stress stability of amorphous silicon thin film transistors"; dated May 2006 (4 pages).
Chaji: "Stable Pixel Circuit for Small-Area High- Resolution a-Si:H AMOLED Displays"; dated Oct. 2008 (6 pages).
Chaji: "Stable RGBW AMOLED display with OLED degradation compensation using electrical feedback"; dated Feb. 2010 (2 pages).
Chaji: "Thin-Film Transistor Integration for Biomedical Imaging and AMOLED Displays"; dated 2008 (177 pages).
European Search Report for Application No. EP 04 78 6661 dated Mar. 9, 2009.
European Search Report for Application No. EP 05 75 9141 dated Oct. 30, 2009 (2 pages).
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).

(56) References Cited

OTHER PUBLICATIONS

European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143 dated Sep. 3, 2010 (2 pages).
European Search Report for Application No. EP 10 83 4294.0-1903 dated Apr. 8, 2013 (9 pages).
European Supplementary Search Report for Application No. EP 04 78 6662 dated Jan. 19, 2007 (2 pages).
Extended European Search Report for Application No. EP 11 73 9485.8 dated Aug. 6, 2013 (14 pages).
Extended European Search Report for Application No. EP 09 73 3076.5 dated Apr. 27, 2011 (13 pages).
Extended European Search Report for Application No. EP 11 16 8677.0 dated Nov. 29, 2012 (13 page).
Extended European Search Report for Application No. EP 11 19 1641.7 dated Jul. 11, 2012 (14 pages).
Extended European Search Report for Application No. EP 10834297 dated Oct. 27, 2014 (6 pages).
Extended European Search Report for Application No. EP 18172034.3 dated Jul. 16, 2018 (12 pages).
Fossum Eric R.. "Active Pixel Sensors: Are CCD's Dinosaurs?" SPIE: Symposium on Electronic Imaging. Feb. 1, 1993 (13 pages).
GOH "A New a-Si:H Thin-Film Transistor Pixel Circuit for Active-Matrix Organic Light-Emitting Diodes" IEEE Electron Device Letters vol. 24 No. 9 Sep. 2003 pp. 583-585.
International Preliminary Report on Patentability for Application No. PCT/CA2005/001007 dated Oct. 16, 2006 4 pages.
International Search Report for Application No. PCT/CA2004/001741 dated Feb. 21, 2005.
International Search Report for Application No. PCT/CA2004/001742 Canadian Patent Office dated Feb. 21, 2005 (2 pages).
International Search Report for Application No. PCT/CA2005/001007 dated Oct. 18, 2005.
International Search Report for Application No. PCT/CA2005/001897 dated Mar. 21, 2006 (2 pages).
International Search Report for Application No. PCT/CA2007/000652 dated Jul. 25, 2007.
International Search Report for Application No. PCT/CA2009/000501 dated Jul. 30, 2009 (4 pages).
International Search Report for Application No. PCT/CA2009/001769 dated Apr. 8, 2010 (3 pages).
International Search Report for Application No. PCT/IB2010/055481 dated Apr. 7, 2011 3 pages.
International Search Report for Application No. PCT/IB2010/055486 dated Apr. 19, 2011 5 pages.
International Search Report for Application No. PCT/IB2014/060959 dated Aug. 28, 2014 5 pages.
International Search Report for Application No. PCT/IB2010/055541 filed Dec. 1, 2010 dated May 26, 2011; 5 pages.
International Search Report for Application No. PCT/IB2011/050502 dated Jun. 27, 2011 (6 pages).
International Search Report for Application No. PCT/IB2011/051103 dated Jul. 8, 2011 3 pages.
International Search Report for Application No. PCT/IB2011/055135 Canadian Patent Office dated Apr. 16, 2012 (5 pages).
International Search Report for Application No. PCT/IB2012/052372 dated Sep. 12, 2012 (3 pages).
International Search Report for Application No. PCT/IB2013/054251 Canadian Intellectual Property Office dated Sep. 11, 2013; (4 pages).
International Search Report for Application No. PCT/JP02/09668 dated Dec. 3, 2002 (4 pages).
International Written Opinion for Application No. PCT/CA2004/001742 Canadian Patent Office dated Feb. 21, 2005 (5 pages).
International Written Opinion for Application No. PCT/CA2005/001897 dated Mar. 21, 2006 (4 pages).
International Written Opinion for Application No. PCT/CA2009/000501 dated Jul. 30, 2009 (6 pages).
International Written Opinion for Application No. PCT/IB2010/055481 dated Apr. 7, 2011 6 pages.
International Written Opinion for Application No. PCT/IB2010/055486 dated Apr. 19, 2011 8 pages.
International Written Opinion for Application No. PCT/IB2010/055541 dated May 26, 2011; 6 pages.
International Written Opinion for Application No. PCT/IB2011/050502 dated Jun. 27, 2011 (7 pages).
International Written Opinion for Application No. PCT/IB2011/051103 dated Jul. 8, 2011 6 pages.
International Written Opinion for Application No. PCT/IB2011/055135 Canadian Patent Office dated Apr. 16, 2012 (5 pages).
International Written Opinion for Application No. PCT/IB2012/052372 dated Sep. 12, 2012 (6 pages).
International Written Opinion for Application No. PCT/IB2013/054251 Canadian Intellectual Property Office dated Sep. 11, 2013; (5 pages).
Jafarabadiashtiani: "A New Driving Method for a-Si AMOLED Displays Based on Voltage Feedback"; dated 2005 (4 pages).
Kanicki J. "Amorphous Silicon Thin-Film Transistors Based Active-Matrix Organic Light-Emitting Displays." Asia Display: International Display Workshops Sep. 2001 (pp. 315-318).
Karim K. S. "Amorphous Silicon Active Pixel Sensor Readout Circuit for Digital Imaging." IEEE: Transactions on Electron Devices. vol. 50 No. 1 Jan. 2003 (pp. 200-208).
Lee : "Ambipolar Thin-Film Transistors Fabricated by PECVD Nanocrystalline Silicon"; dated 2006.
Lee Wonbok: "Thermal Management in Microprocessor Chips and Dynamic Backlight Control in Liquid Crystal Displays" Ph.D. Dissertation University of Southern California, Aug. 2008 (124 pages).
Liu P. Innovative Voltage Driving Pixel Circuit Using Organic Thin-Film Transistor for AMOLEDs Journal of Display Technology vol. 5 Issue 6 Jun. 2009 (pp. 224-227).
Ma E Y: "organic light emitting diode/thin film transistor integration for foldable displays" dated Sep. 15, 1997(4 pages).
Matsueda y: "35.1: 2.5-in. AMOLED with Integrated 6-bit Gamma Compensated Digital Data Driver"; dated May 2004.
Mendes E. "A High Resolution Switch-Current Memory Base Cell." IEEE: Circuits and Systems. vol. 2 Aug. 1999 (pp. 718-721).
Nathan A. "Thin Film imaging technology on glass and plastic" ICM 2000 proceedings of the 12 international conference on microelectronics dated Oct. 31, 2001 (4 pages).
Nathan "Amorphous Silicon Thin Film Transistor Circuit Integration for Organic LED Displays on Glass and Plastic" IEEE Journal of Solid-State Circuits vol. 39 No. 9 Sep. 2004 pp. 1477-1486.
Nathan: "Backplane Requirements for active Matrix Organic Light Emitting Diode Displays"; dated 2006 (16 pages).
Nathan: "Call for papers second international workshop on compact thin-film transistor (TFT) modeling for circuit simulation"; dated Sep. 2009 (1 page).
Nathan: "Driving schemes for a-Si and LTPS AMOLED displays"; dated Dec. 2005 (11 pages).
Nathan: "Invited Paper: a-Si for AMOLED—Meeting the Performance and Cost Demands of Display Applications (Cell Phone to HDTV)"; dated 2006 (4 pages).
Office Action in Japanese patent application No. JP2012-541612 dated Jul. 15, 2014. (3 pages).
Partial European Search Report for Application No. EP 11 168 677.0 dated Sep. 22, 2011 (5 pages).
Partial European Search Report for Application No. EP 11 19 1641.7 dated Mar. 20, 2012 (8 pages).
Philipp: "Charge transfer sensing" Sensor Review vol. 19 No. 2 Dec. 31, 1999 (Dec. 31, 1999) 10 pages.
Rafati: "Comparison of a 17 b multiplier in Dual-rail domino and in Dual-rail D L (D L) logic styles"; dated 2002 (4 pages).
Safavian: "3-TFT active pixel sensor with correlated double sampling readout circuit for real-time medical x-ray imaging"; dated Jun. 2006 (4 pages).

(56) References Cited

OTHER PUBLICATIONS

Safavian: "A novel current scaling active pixel sensor with correlated double sampling readout circuit for real time medical x-ray imaging"; dated May 2007 (7 pages).
Safavian: "A novel hybrid active-passive pixel with correlated double sampling CMOS readout circuit for medical x-ray imaging"; dated May 2008 (4 pages).
Safavian: "Self-compensated a-Si:H detector with current-mode readout circuit for digital X-ray fluoroscopy"; dated Aug. 2005 (4 pages).
Safavian: "TFT active image sensor with current-mode readout circuit for digital x-ray fluoroscopy [5969D-82]"; dated Sep. 2005 (9 pages).
Safavian: "Three-TFT image sensor for real-time digital X-ray imaging"; dated Feb. 2, 2006 (2 pages).
Singh "Current Conveyor: Novel Universal Active Block" Samriddhi S-JPSET vol. I Issue 1 2010 pp. 41-48 (12EPPT).
Smith Lindsay I. "A tutorial on Principal Components Analysis" dated Feb. 26, 2001 (27 pages).
Spindler System Considerations for RGBW OLED Displays Journal of the SID Jan. 14, 2006 pp. 37-48.
Snorre Aunet: "switched capacitors circuits" University of Oslo Mar. 7, 2011 (Mar. 7, 2011) XP002729694 Retrieved from the Internet: URL:http://www.uio.no/studier/emner/matnat/ifi/INF4420/v11/undervisningsmateriale/INF4420_V11_0308_1.pdf [retrieved on Sep. 9, 2014].
Stewart M. "polysilicon TFT technolgy for active matrix oled displays" IEEE transactions on electron devices vol. 48 No. 5 dated May 2001 (7 pages).
Vygranenko: "Stability of indium-oxide thin-film transistors by reactive ion beam assisted deposition"; dated 2009.
Wang: "Indium oxided by reactive ion beam assisted evaporation: From material study to device application"; dated Mar. 2009 (6 pages).
Yi He "Current-Source a-Si:H Thin Film Transistor Circuit for Active-Matrix Organic Light-Emitting Displays" IEEE Electron Device Letters vol. 21 No. 12 Dec. 2000 pp. 590-592.
Yu Jennifer: "Improve OLED Technology for Display" Ph.D. Dissertation Massachusetts Institute of Technology Sep. 2008 (151 pages).
International Search Report for Application No. PCT/IB2014/058244 Canadaian Intellectual Property Office dated Apr. 11, 2014; (6 pages).
International Search Report for Application No. PCT/IB2014/059753 Canadian Intellectual Property Office dated Jun. 23, 2014; (6 pages).
Written Opinion for Application No. PCT/IB2014/059753 Canadian Intellectual Property Office dated Jun. 12, 2014 (6 pages).
International Search Report for Application No. PCT/IB2014/060879 Canadian Intellectual Property Office dated Jul. 17, 2014 (3 pages).
International Search Report and Written Opinion of International Searching Authority for Application No. PCT/IB2014/059697 dated Oct. 15, 2014 (13 pages).
Extended European Search Report for Application No. EP 14158051.4 dated Jul. 29, 2014 (4 pages).
Office Action in Chinese Patent Invention No. 201180008188.9 dated Jun. 4, 2014 (17 pages).
International Search Report for Application No. PCT/IB/2014/066932 dated Mar. 24, 2015.
Written Opinion for Application No. PCT/IB/2014/066932 dated Mar. 24, 2015.
Extended European Search Report for Application No. EP 11866291.5 dated Mar. 9, 2015 (9 pages).
Extended European Search Report for Application No. EP 14181848.4 dated Mar. 5, 2015 (8 pages).
Office Action in Chinese Patent Invention No. 201280022957.5 dated Jun. 26, 2015 (7 pages).
Extended European Search Report for Application No. EP 13794695.0 dated Dec. 18, 2015 (9 pages).
Extended European Search Report for Application No. EP 16157746.5 dated Apr. 8, 2016 (11 pages).
Extended European Search Report for Application No. EP 16192749.6 dated Dec. 15, 2016 (17 pages).
International Search Report for Application No. PCT/IB/2016/054763 dated Nov. 25, 2016 (4 pages).
Written Opinion for Application No. PCT/IB/2016/054763 dated Nov. 25, 2016 (9 pages).
Extended European Search Report for Application No. EP 17195377.1 dated Feb. 12, 2018 (8 pages).
Extended European Search Report for Application No. EP 18150300.4 dated Mar. 14, 2018 (11 pages).
Jafarabadiashtiani, S.; "Pixel Circuits and Driving Schemes for Active-Matrix Organic Light-Emitting Diode Displays"; 2007 University of Waterloo, Electrical and Computer Engineering (188 pages).
Japanese Office Action for Japanese Application No. 2012-551728, dated Jan. 6, 2015 (11 pages) (w/English translation).

* cited by examiner

SYSTEM AND METHODS FOR EXTRACTING CORRELATION CURVES FOR AN ORGANIC LIGHT EMITTING DEVICE

CROSS-REFERENCE TO RELATED APPLICATIONS

This application is a continuation of U.S. patent application Ser. No. 14/590,105, filed Jan. 6, 2015, now allowed, which is a continuation-in-part of and claims priority to U.S. patent application Ser. No. 14/322,443, filed Jul. 2, 2014, which is a continuation-in-part of U.S. patent application Ser. No. 14/314,514, filed Jun. 25, 2014, which is a continuation-in-part of U.S. patent application Ser. No. 14/286,711, filed May 23, 2014, now U.S. Pat. No. 9,881,532, which is a continuation-in-part of U.S. patent application Ser. No. 14/027,811, filed Sep. 16, 2013, now U.S. Pat. No. 9,430,958, which is a continuation of U.S. patent application Ser. No. 13/020,252, filed Feb. 3, 2011, now U.S. Pat. No. 8,589,100, which claims priority to Canadian Application No. 2,692,097, filed Feb. 4, 2010, each of which is hereby incorporated by reference herein in its entirety.

FIELD OF THE INVENTION

This invention is directed generally to displays that use light emissive devices such as OLEDs and, more particularly, to extracting characterization correlation curves under different stress conditions in such displays to compensate for aging of the light emissive devices.

BACKGROUND

Active matrix organic light emitting device ("AMOLED") displays offer the advantages of lower power consumption, manufacturing flexibility, and faster refresh rate over conventional liquid crystal displays. In contrast to conventional liquid crystal displays, there is no backlighting in an AMOLED display as each pixel consists of different colored OLEDs emitting light independently. The OLEDs emit light based on current supplied through a drive transistor. The drive transistor is typically a thin film transistor (TFT). The power consumed in each pixel has a direct relation with the magnitude of the generated light in that pixel.

During operation of an organic light emitting diode device, it undergoes degradation, which causes light output at a constant current to decrease over time. The OLED device also undergoes an electrical degradation, which causes the current to drop at a constant bias voltage over time. These degradations are caused primarily by stress related to the magnitude and duration of the applied voltage on the OLED and the resulting current passing through the device. Such degradations are compounded by contributions from the environmental factors such as temperature, humidity, or presence of oxidants over time. The aging rate of the thin film transistor devices is also environmental and stress (bias) dependent. The aging of the drive transistor and the OLED may be properly determined via calibrating the pixel against stored historical data from the pixel at previous times to determine the aging effects on the pixel. Accurate aging data is therefore necessary throughout the lifetime of the display device.

In one compensation technique for OLED displays, the aging (and/or uniformity) of a panel of pixels is extracted and stored in lookup tables as raw or processed data. Then a compensation module uses the stored data to compensate for any shift in electrical and optical parameters of the OLED (e.g., the shift in the OLED operating voltage and the optical efficiency) and the backplane (e.g., the threshold voltage shift of the TFT), hence the programming voltage of each pixel is modified according to the stored data and the video content. The compensation module modifies the bias of the driving TFT in a way that the OLED passes enough current to maintain the same luminance level for each gray-scale level. In other words, a correct programming voltage properly offsets the electrical and optical aging of the OLED as well as the electrical degradation of the TFT.

The electrical parameters of the backplane TFTs and OLED devices are continuously monitored and extracted throughout the lifetime of the display by electrical feedback-based measurement circuits. Further, the optical aging parameters of the OLED devices are estimated from the OLED's electrical degradation data. However, the optical aging effect of the OLED is dependent on the stress conditions placed on individual pixels as well, and since the stresses vary from pixel to pixel, accurate compensation is not assured unless the compensation tailored for a specific stress level is determined.

There is therefore a need for efficient extraction of characterization correlation curves of the optical and electrical parameters that are accurate for stress conditions on active pixels for compensation for aging and other effects. There is also a need for having a variety of characterization correlation curves for a variety of stress conditions that the active pixels may be subjected to during operation of the display. There is a further need for accurate compensation systems for pixels in an organic light emitting device based display.

SUMMARY

In accordance with one embodiment, a system is provided for equalizing the pixels in an array of pixels that include semiconductor devices that age differently under different ambient and stress conditions. The system extracts at least one pixel parameter from the array; creates a stress pattern for the array, based on the extracted pixel parameter; stresses the pixels in accordance with the stress pattern; extracts the pixel parameter from the stressed pixels; determines whether the pixel parameter extracted from the stressed pixels is within a preselected range and, when the answer is negative, creates a second stress pattern for the array, based on the pixel parameter extracted from the stressed pixels, stresses the pixels in accordance with the second stress pattern, extracts the pixel parameter from the stressed pixels, and determines whether the pixel parameter extracted from the stressed pixels is within the preselected range. When the answer is positive, the array of pixels is returned to normal operation.

In another embodiment, the system creates a stress history of the pixels during a usage cycle; extracts at least one pixel parameter from the array after the usage cycle; creates a stress pattern for the array, based on the extracted pixel parameter; stresses the pixels in accordance with the stress pattern; extracts the pixel parameter from the stressed pixels; determines whether the pixel parameter extracted from the stressed pixels is within a preselected range and, when the answer is negative, creates a second stress pattern for the array, based on the pixel parameter extracted from the stressed pixels, stresses the pixels in accordance with the second stress pattern, extracts the pixel parameter from the stressed pixels, and determines whether the pixel parameter extracted from the stressed pixels is within the preselected range. When the answer is positive, the array of pixels is returned to normal operation.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

Figure 1:
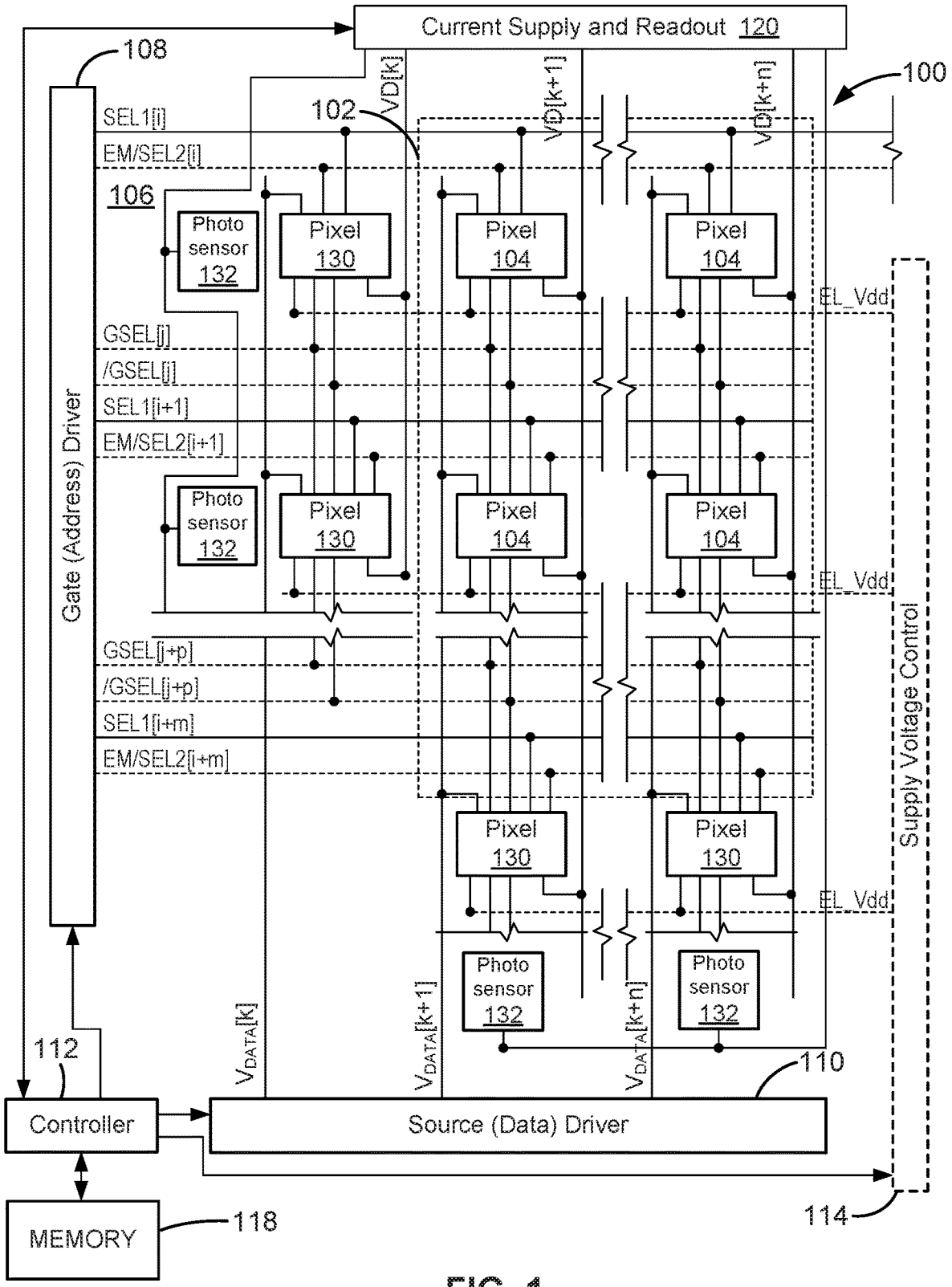
FIG. 1 is a block diagram of an AMOLED display system with compensation control.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

FIG. 1 is an electronic display system 100 having an active matrix area or pixel array 102 in which an array of active pixels 104 are arranged in a row and column configuration. For ease of illustration, only two rows and columns are shown. External to the active matrix area, which is the pixel array 102, is a peripheral area 106 where peripheral circuitry for driving and controlling the area of the pixel array 102 are disposed. The peripheral circuitry includes a gate or address driver circuit 108, a source or data driver circuit 110, a controller 112, and an optional supply voltage (e.g., EL_Vdd) driver 114. The controller 112 controls the gate, source, and supply voltage drivers 108, 110, 114. The gate driver 108, under control of the controller 112, operates on address or select lines SEL[i], SEL[i+1], and so forth, one for each row of pixels 104 in the pixel array 102. In pixel sharing configurations described below, the gate or address driver circuit 108 can also optionally operate on global select lines GSEL[j] and optionally/GSEL[j], which operate on multiple rows of pixels 104 in the pixel array 102, such as every two rows of pixels 104. The source driver circuit 110, under control of the controller 112, operates on voltage data lines Vdata[k], Vdata[k+1], and so forth, one for each column of pixels 104 in the pixel array 102. The voltage data lines carry voltage programming information to each pixel 104 indicative of brightness of each light emitting device in the pixel 104. A storage element, such as a capacitor, in each pixel 104 stores the voltage programming information until an emission or driving cycle turns on the light emitting device. The optional supply voltage driver 114, under control of the controller 112, controls a supply voltage (EL Vdd) line, one for each row of pixels 104 in the pixel array 102. The controller 112 is also coupled to a memory 118 that stores various characterization correlation curves and aging parameters of the pixels 104 as will be explained below. The memory 118 may be one or more of a flash memory, an SRAM, a DRAM, combinations thereof, and/or the like.

The display system 100 may also include a current source circuit, which supplies a fixed current on current bias lines. In some configurations, a reference current can be supplied to the current source circuit. In such configurations, a current source control controls the timing of the application of a bias current on the current bias lines. In configurations in which the reference current is not supplied to the current source circuit, a current source address driver controls the timing of the application of a bias current on the current bias lines.

As is known, each pixel 104 in the display system 100 needs to be programmed with information indicating the brightness of the light emitting device in the pixel 104. A frame defines the time period that includes a programming cycle or phase during which each and every pixel in the display system 100 is programmed with a programming voltage indicative of a brightness and a driving or emission cycle or phase during which each light emitting device in each pixel is turned on to emit light at a brightness commensurate with the programming voltage stored in a storage element. A frame is thus one of many still images that compose a complete moving picture displayed on the display system 100. There are at least two schemes for programming and driving the pixels: row-by-row, or frame-by-frame. In row-by-row programming, a row of pixels is programmed and then driven before the next row of pixels is programmed and driven. In frame-by-frame programming, all rows of pixels in the display system 100 are programmed first, and all of the frames are driven row-by-row. Either scheme can employ a brief vertical blanking time at the beginning or end of each period during which the pixels are neither programmed nor driven.

The components located outside of the pixel array 102 may be disposed in a peripheral area 106 around the pixel array 102 on the same physical substrate on which the pixel array 102 is disposed. These components include the gate driver 108, the source driver 110, and the optional supply voltage control 114. Alternately, some of the components in the peripheral area can be disposed on the same substrate as the pixel array 102 while other components are disposed on a different substrate, or all of the components in the peripheral area can be disposed on a substrate different from the substrate on which the pixel array 102 is disposed. Together, the gate driver 108, the source driver 110, and the supply voltage control 114 make up a display driver circuit. The display driver circuit in some configurations may include the gate driver 108 and the source driver 110 but not the supply voltage control 114.

The display system 100 further includes a current supply and readout circuit 120, which reads output data from data output lines, VD [k], VD [k+1], and so forth, one for each column of active pixels 104 in the pixel array 102. A set of optional reference devices such as reference pixels 130 is fabricated on the edge of the pixel array 102 outside the active pixels 104 in the peripheral area 106. The reference pixels 130 also may receive input signals from the controller 112 and may output data signals to the current supply and readout circuit 120. The reference pixels 130 include the drive transistor and an OLED but are not part of the pixel array 102 that displays images. As will be explained below, different groups of reference pixels 130 are placed under different stress conditions via different current levels from the current supply circuit 120. Because the reference pixels 130 are not part of the pixel array 102 and thus do not display images, the reference pixels 130 may provide data indicating the effects of aging at different stress conditions. Although only one row and column of reference pixels 130 is shown in FIG. 1, it is to be understood that there may be any number of reference pixels. Each of the reference pixels 130 in the example shown in FIG. 1 are fabricated next to a corresponding photo sensor 132. The photo sensor 132 is used to determine the luminance level emitted by the corresponding reference pixel 130. It is to be understood that reference devices such as the reference pixels 130 may be a stand alone device rather than being fabricated on the display with the active pixels 104.

Figure 2:
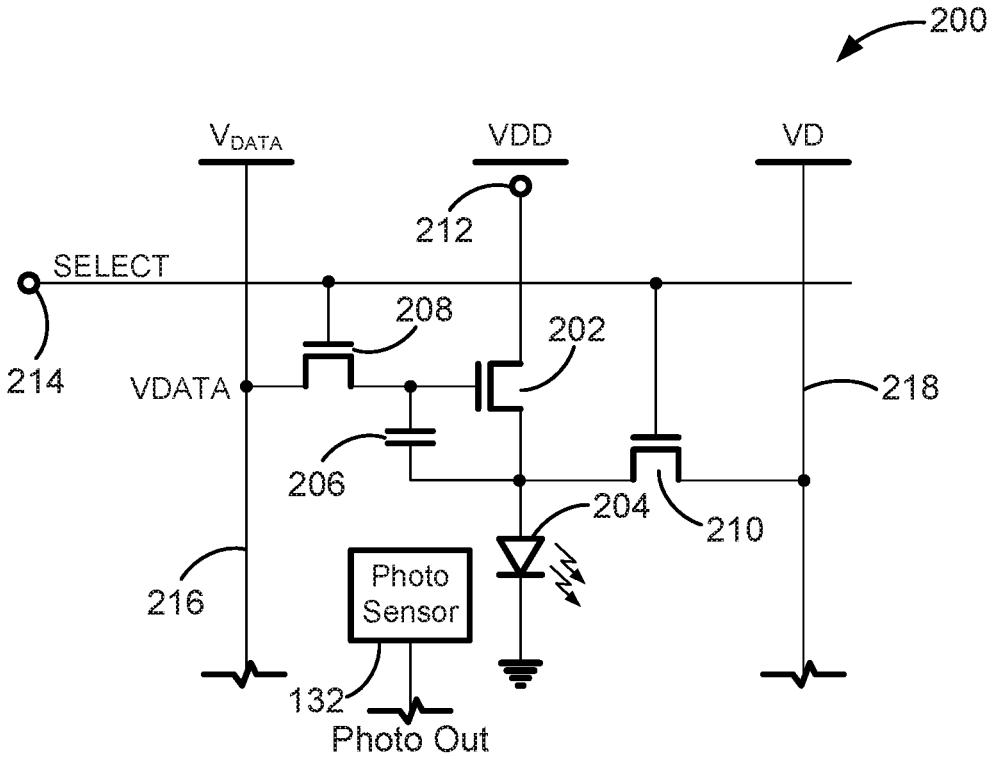
FIG. 2 is a circuit diagram of one of the reference pixels in FIG. 1 for modifying characterization correlation curves based on the measured data.

FIG. 2 shows one example of a driver circuit 200 for one of the example reference pixels 130 in FIG. 1. The driver circuit 200 of the reference pixel 130 includes a drive transistor 202, an organic light emitting device ("OLED") 204, a storage capacitor 206, a select transistor 208 and a monitoring transistor 210. A voltage source 212 is coupled to the drive transistor 202. As shown in FIG. 2, the drive transistor 202 is a thin film transistor in this example that is fabricated from amorphous silicon. A select line 214 is coupled to the select transistor 208 to activate the driver circuit 200. A voltage programming input line 216 allows a programming voltage to be applied to the drive transistor 202. A monitoring line 218 allows outputs of the OLED 204 and/or the drive transistor 202 to be monitored. The select line 214 is coupled to the select transistor 208 and the monitoring transistor 210. During the readout time, the select line 214 is pulled high. A programming voltage may be applied via the programming voltage input line 216. A monitoring voltage may be read from the monitoring line 218 that is coupled to the monitoring transistor 210. The signal to the select line 214 may be sent in parallel with the pixel programming cycle.

The reference pixel 130 may be stressed at a certain current level by applying a constant voltage to the programming voltage input line 216. As will be explained below, the voltage output measured from the monitoring line 218 based on a reference voltage applied to the programming voltage input line 216 allows the determination of electrical characterization data for the applied stress conditions over the time of operation of the reference pixel 130. Alternatively, the monitor line 218 and the programming voltage input line 216 may be merged into one line (i.e., Data/Mon) to carry out both the programming and monitoring functions through that single line. The output of the photo-sensor 132 allows the determination of optical characterization data for stress conditions over the time of operation for the reference pixel 130.

The display system 100 in FIG. 1, according to one exemplary embodiment, in which the brightness of each pixel (or subpixel) is adjusted based on the aging of at least one of the pixels, to maintain a substantially uniform display over the operating life of the system (e.g., 75,000 hours). Non-limiting examples of display devices incorporating the display system 100 include a mobile phone, a digital camera, a personal digital assistant (PDA), a computer, a television, a portable video player, a global positioning system (GPS), etc.

As the OLED material of an active pixel 104 ages, the voltage required to maintain a constant current for a given level through the OLED increases. To compensate for electrical aging of the OLEDs, the memory 118 stores the required compensation voltage of each active pixel to maintain a constant current. It also stores data in the form of characterization correlation curves for different stress conditions that is utilized by the controller 112 to determine compensation voltages to modify the programming voltages to drive each OLED of the active pixels 104 to correctly display a desired output level of luminance by increasing the OLED's current to compensate for the optical aging of the OLED. In particular, the memory 118 stores a plurality of predefined characterization correlation curves or functions, which represent the degradation in luminance efficiency for OLEDs operating under different predetermined stress conditions. The different predetermined stress conditions generally represent different types of stress or operating conditions that an active pixel 104 may undergo during the lifetime of the pixel. Different stress conditions may include constant current requirements at different levels from low to high, constant luminance requirements from low to high, or a mix of two or more stress levels. For example, the stress levels may be at a certain current for some percentage of the time and another current level for another percentage of the time. Other stress levels may be specialized such as a level representing an average streaming video displayed on the display system 100. Initially, the base line electrical and optical characteristics of the reference devices such as the reference pixels 130 at different stress conditions are stored in the memory 118. In this example, the baseline optical characteristic and the baseline electrical characteristic of the reference device are measured from the reference device immediately after fabrication of the reference device.

Each such stress condition may be applied to a group of reference pixels such as the reference pixels 130 by maintaining a constant current through the reference pixel 130 over a period of time, maintaining a constant luminance of the reference pixel 130 over a period of time, and/or varying the current through or luminance of the reference pixel at different predetermined levels and predetermined intervals over a period of time. The current or luminance level(s) generated in the reference pixel 130 can be, for example, high values, low values, and/or average values expected for the particular application for which the display system 100 is intended. For example, applications such as a computer monitor require high values. Similarly, the period(s) of time for which the current or luminance level(s) are generated in the reference pixel may depend on the particular application for which the display system 100 is intended.

It is contemplated that the different predetermined stress conditions are applied to different reference pixels 130 during the operation of the display system 100 in order to replicate aging effects under each of the predetermined stress conditions. In other words, a first predetermined stress condition is applied to a first set of reference pixels, a second predetermined stress condition is applied to a second set of reference pixels, and so on. In this example, the display system 100 has groups of reference pixels 130 that are stressed under 16 different stress conditions that range from a low current value to a high current value for the pixels. Thus, there are 16 different groups of reference pixels 130 in this example. Of course, greater or lesser numbers of stress conditions may be applied depending on factors such as the desired accuracy of the compensation, the physical space in the peripheral area 106, the amount of processing power available, and the amount of memory for storing the characterization correlation curve data.

By continually subjecting a reference pixel or group of reference pixels to a stress condition, the components of the reference pixel are aged according to the operating conditions of the stress condition. As the stress condition is applied to the reference pixel during the operation of the system 100, the electrical and optical characteristics of the reference pixel are measured and evaluated to determine data for determining correction curves for the compensation of aging in the active pixels 104 in the array 102. In this example, the optical characteristics and electrical characteristics are measured once an hour for each group of reference pixels 130. The corresponding characteristic correlation curves are therefore updated for the measured characteristics of the reference pixels 130. Of course, these measurements may be made in shorter periods of time or for longer periods of time depending on the accuracy desired for aging compensation.

Generally, the luminance of the OLED 204 has a direct linear relationship with the current applied to the OLED 204. The optical characteristic of an OLED may be expressed as:

$$L=O*I$$

In this equation, luminance, L, is a result of a coefficient, O, based on the properties of the OLED multiplied by the current I. As the OLED 204 ages, the coefficient O decreases and therefore the luminance decreases for a constant current value. The measured luminance at a given current may therefore be used to determine the characteristic change in the coefficient, O, due to aging for a particular OLED 204 at a particular time for a predetermined stress condition.

The measured electrical characteristic represents the relationship between the voltage provided to the drive transistor 202 and the resulting current through the OLED 204. For example, the change in voltage required to achieve a constant current level through the OLED of the reference pixel may be measured with a voltage sensor or thin film transistor such as the monitoring transistor 210 in FIG. 2. The required voltage generally increases as the OLED 204 and drive transistor 202 ages. The required voltage has a power law relation with the output current as shown in the following equation $$I=k*(V-e)^a$$

In this equation, the current is determined by a constant, k, multiplied by the input voltage, V, minus a coefficient, e, which represents the electrical characteristics of the drive transistor 202. The voltage therefore has a power law relation by the variable, a, to the current, I. As the transistor 202 ages, the coefficient, e, increases thereby requiring greater voltage to produce the same current. The measured current from the reference pixel may therefore be used to determine the value of the coefficient, e, for a particular reference pixel at a certain time for the stress condition applied to the reference pixel.

As explained above, the optical characteristic, O, represents the relationship between the luminance generated by the OLED 204 of the reference pixel 130 as measured by the photo sensor 132 and the current through the OLED 204 in FIG. 2. The measured electrical characteristic, e, represents the relationship between the voltage applied and the resulting current. The change in luminance of the reference pixel 130 at a constant current level from a baseline optical characteristic may be measured by a photo sensor such as the photo sensor 132 in FIG. 1 as the stress condition is applied to the reference pixel. The change in electric characteristics, e, from a baseline electrical characteristic may be measured from the monitoring line to determine the current output. During the operation of the display system 100, the stress condition current level is continuously applied to the reference pixel 130. When a measurement is desired, the stress condition current is removed and the select line 214 is activated. A reference voltage is applied and the resulting luminance level is taken from the output of the photo sensor 132 and the output voltage is measured from the monitoring line 218. The resulting data is compared with previous optical and electrical data to determine changes in current and luminance outputs for a particular stress condition from aging to update the characteristics of the reference pixel at the stress condition. The updated characteristics data is used to update the characteristic correlation curve.

Then by using the electrical and optical characteristics measured from the reference pixel, a characterization correlation curve (or function) is determined for the predetermined stress condition over time. The characterization correlation curve provides a quantifiable relationship between the optical degradation and the electrical aging expected for a given pixel operating under the stress condition. More particularly, each point on the characterization correlation curve determines the correlation between the electrical and optical characteristics of an OLED of a given pixel under the stress condition at a given time where measurements are taken from the reference pixel 130. The characteristics may then be used by the controller 112 to determine appropriate compensation voltages for active pixels 104 that have been aged under the same stress conditions as applied to the reference pixels 130. In another example, the baseline optical characteristic may be periodically measured from a base OLED device at the same time as the optical characteristic of the OLED of the reference pixel is being measured. The base OLED device either is not being stressed or being stressed on a known and controlled rate. This will eliminate any environmental effect on the reference OLED characterization.

Due to manufacturing processes and other factors known to those skilled in the art, each reference pixel 130 of the display system 100 may not have uniform characteristics, resulting in different emitting performances. One technique is to average the values for the electrical characteristics and the values of the luminance characteristics obtained by a set of reference pixels under a predetermined stress condition. A better representation of the effect of the stress condition on an average pixel is obtained by applying the stress condition to a set of the reference pixels 130 and applying a polling-averaging technique to avoid defects, measurement noise, and other issues that can arise during application of the stress condition to the reference pixels. For example, faulty values such as those determined due to noise or a dead reference pixel may be removed from the averaging. Such a technique may have predetermined levels of luminance and electrical characteristics that must be met before inclusion of those values in the averaging. Additional statistical regression techniques may also be utilized to provide less weight to electrical and optical characteristic values that are significantly different from the other measured values for the reference pixels under a given stress condition.

In this example, each of the stress conditions is applied to a different set of reference pixels. The optical and electrical characteristics of the reference pixels are measured, and a polling-averaging technique and/or a statistical regression technique are applied to determine different characterization correlation curves corresponding to each of the stress conditions. The different characterization correlation curves are stored in the memory 118. Although this example uses reference devices to determine the correlation curves, the correlation curves may be determined in other ways such as from historical data or predetermined by a manufacturer.

During the operation of the display system 100, each group of the reference pixels 130 may be subjected to the respective stress conditions and the characterization correlation curves initially stored in the memory 118 may be updated by the controller 112 to reflect data taken from the reference pixels 130 that are subject to the same external conditions as the active pixels 104. The characterization correlation curves may thus be tuned for each of the active pixels 104 based on measurements made for the electrical and luminance characteristics of the reference pixels 130 during operation of the display system 100. The electrical and luminance characteristics for each stress condition are therefore stored in the memory 118 and updated during the operation of the display system 100. The storage of the data may be in a piecewise linear model. In this example, such a piecewise linear model has 16 coefficients that are updated as the reference pixels 130 are measured for voltage and luminance characteristics. Alternatively, a curve may be determined and updated using linear regression or by storing data in a look up table in the memory 118.

To generate and store a characterization correlation curve for every possible stress condition would be impractical due to the large amount of resources (e.g., memory storage, processing power, etc.) that would be required. The disclosed display system 100 overcomes such limitations by determining and storing a discrete number of characterization correlation curves at predetermined stress conditions and subsequently combining those predefined characterization correlation curves using linear or nonlinear algorithm(s) to synthesize a compensation factor for each pixel 104 of the display system 100 depending on the particular operating condition of each pixel. As explained above, in this example there are a range of 16 different predetermined stress conditions and therefore 16 different characterization correlation curves stored in the memory 118.

For each pixel 104, the display system 100 analyzes the stress condition being applied to the pixel 104, and determines a compensation factor using an algorithm based on the predefined characterization correlation curves and the measured electrical aging of the panel pixels. The display system 100 then provides a voltage to the pixel based on the compensation factor. The controller 112 therefore determines the stress of a particular pixel 104 and determines the closest two predetermined stress conditions and attendant characteristic data obtained from the reference pixels 130 at those predetermined stress conditions for the stress condition of the particular pixel 104. The stress condition of the active pixel 104 therefore falls between a low predetermined stress condition and a high predetermined stress condition.

The following examples of linear and nonlinear equations for combining characterization correlation curves are described in terms of two such predefined characterization correlation curves for ease of disclosure; however, it is to be understood that any other number of predefined characterization correlation curves can be utilized in the exemplary techniques for combining the characterization correlation curves. The two exemplary characterization correlation curves include a first characterization correlation curve determined for a high stress condition and a second characterization correlation curve determined for a low stress condition.

Figure 3:
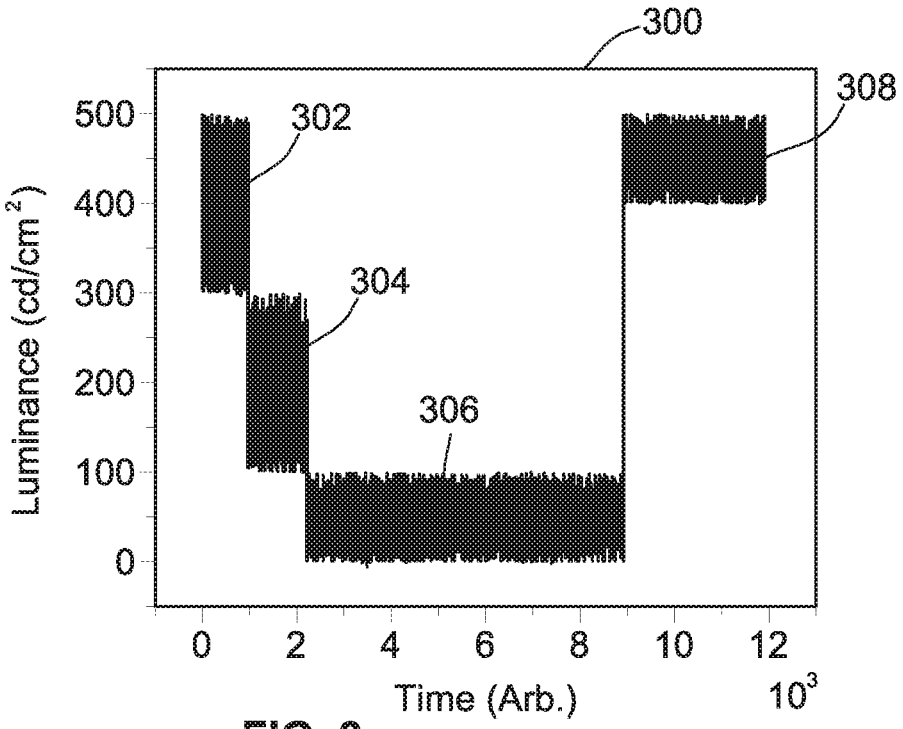
FIG. 3 is a graph of luminance emitted from an active pixel reflecting the different levels of stress conditions over time that may require different compensation.

The ability to use different characterization correlation curves over different levels provides accurate compensation for active pixels 104 that are subjected to different stress conditions than the predetermined stress conditions applied to the reference pixels 130. FIG. 3 is a graph showing different stress conditions over time for an active pixel 104 that shows luminance levels emitted over time. During a first time period, the luminance of the active pixel is represented by trace 302, which shows that the luminance is between 300 and 500 nits (cd/cm$^2$). The stress condition applied to the active pixel during the trace 302 is therefore relatively high. In a second time period, the luminance of the active pixel is represented by a trace 304, which shows that the luminance is between 300 and 100 nits. The stress condition during the trace 304 is therefore lower than that of the first time period and the age effects of the pixel during this time differ from the higher stress condition. In a third time period, the luminance of the active pixel is represented by a trace 306, which shows that the luminance is between 100 and 0 nits. The stress condition during this period is lower than that of the second period. In a fourth time period, the luminance of the active pixel is represented by a trace 308 showing a return to a higher stress condition based on a higher luminance between 400 and 500 nits.

The limited number of reference pixels 130 and corresponding limited numbers of stress conditions may require the use of averaging or continuous (moving) averaging for the specific stress condition of each active pixel 104. The specific stress conditions may be mapped for each pixel as a linear combination of characteristic correlation curves from several reference pixels 130. The combinations of two characteristic curves at predetermined stress conditions allow accurate compensation for all stress conditions occurring between such stress conditions. For example, the two reference characterization correlation curves for high and low stress conditions allow a close characterization correlation curve for an active pixel having a stress condition between the two reference curves to be determined. The first and second reference characterization correlation curves stored in the memory 118 are combined by the controller 112 using a weighted moving average algorithm. A stress condition at a certain time St ($t_i$) for an active pixel may be represented by:

$$St(t_i)=(St(t_{i-1})*k_{avg}+L(t_i))/(k_{avg}+1)$$

In this equation, $St(t_{i-1})$ is the stress condition at a previous time, $k_{avg}$ is a moving average constant. $L(t_i)$ is the measured luminance of the active pixel at the certain time, which may be determined by:

$$L(t_i) = L_{peak}\left(\frac{g(t_i)}{g_{peak}}\right)^{\gamma}$$

In this equation, $L_{peak}$ is the highest luminance permitted by the design of the display system 100. The variable, $g(t_i)$ is the grayscale at the time of measurement, $g_{peak}$ is the highest grayscale value of use (e.g. 255) and is a gamma constant. A weighted moving average algorithm using the characterization correlation curves of the predetermined high and low stress conditions may determine the compensation factor, $K_{comp}$, via the following equation:

$$K_{comp}=K_{high}f_{high}(\Delta I)+K_{low}f_{low}(\Delta I)$$

In this equation, $f_{high}$ is the first function corresponding to the characterization correlation curve for a high predetermined stress condition and $f_{low}$ is the second function corresponding to the characterization correlation curve for a low predetermined stress condition. ΔI is the change in the current in the OLED for a fixed voltage input, which shows the change (electrical degradation) due to aging effects measured at a particular time. It is to be understood that the change in current may be replaced by a change in voltage, ΔV, for a fixed current. $K_{high}$ is the weighted variable assigned to the characterization correlation curve for the high stress condition and $K_{low}$, is the weight assigned to the characterization correlation curve for the low stress condition. The weighted variables $K_{high}$ and $K_{low}$ may be determined from the following equations:

$$K_{high}=St(t_i)/L_{high}$$

$$K_{low}=1-K_{high}$$

Where $L_{high}$ is the luminance that was associated with the high stress condition.

The change in voltage or current in the active pixel at any time during operation represents the electrical characteristic while the change in current as part of the function for the high or low stress condition represents the optical characteristic. In this example, the luminance at the high stress condition, the peak luminance, and the average compensation factor (function of difference between the two characterization correlation curves), $K_{avg}$, are stored in the memory 118 for determining the compensation factors for each of the active pixels. Additional variables are stored in the memory 118 including, but not limited to, the grayscale value for the maximum luminance permitted for the display system 100 (e.g., grayscale value of 255). Additionally, the average compensation factor, $K_{avg}$, may be empirically determined from the data obtained during the application of stress conditions to the reference pixels.

As such, the relationship between the optical degradation and the electrical aging of any pixel 104 in the display system 100 may be tuned to avoid errors associated with divergence in the characterization correlation curves due to different stress conditions. The number of characterization correlation curves stored may also be minimized to a number providing confidence that the averaging technique will be sufficiently accurate for required compensation levels.

The compensation factor, $K_{comp}$ can be used for compensation of the OLED optical efficiency aging for adjusting programming voltages for the active pixel. Another technique for determining the appropriate compensation factor for a stress condition on an active pixel may be termed dynamic moving averaging. The dynamic moving averaging technique involves changing the moving average coefficient, $K_{avg}$, during the lifetime of the display system 100 to compensate between the divergence in two characterization correlation curves at different predetermined stress conditions in order to prevent distortions in the display output. As the OLEDs of the active pixels age, the divergence between two characterization correlation curves at different stress conditions increases. Thus, $K_{avg}$ may be increased during the lifetime of the display system 100 to avoid a sharp transition between the two curves for an active pixel having a stress condition falling between the two predetermined stress conditions. The measured change in current, may be used to adjust the $K_{avg}$ value to improve the performance of the algorithm to determine the compensation factor.

Another technique to improve performance of the compensation process termed event-based moving averaging is to reset the system after each aging step. This technique further improves the extraction of the characterization correlation curves for the OLEDs of each of the active pixels 104. The display system 100 is reset after every aging step (or after a user turns on or off the display system 100). In this example, the compensation factor, $K_{comp}$ is determined by $$K_{comp}=K_{comp_evt}+K_{high}(f_{high}(\Delta I)-f_{high}(\Delta I_{evt}))+K_{low}(f_{low}(\Delta I)-f_{low}(\Delta I_{evt}))$$

In this equation, $K_{comp_evt}$ is the compensation factor calculated at a previous time, and $\Delta I_{evt}$ is the change in the OLED current during the previous time at a fixed voltage. As with the other compensation determination technique, the change in current may be replaced with the change in an OLED voltage change under a fixed current.

Figure 4:
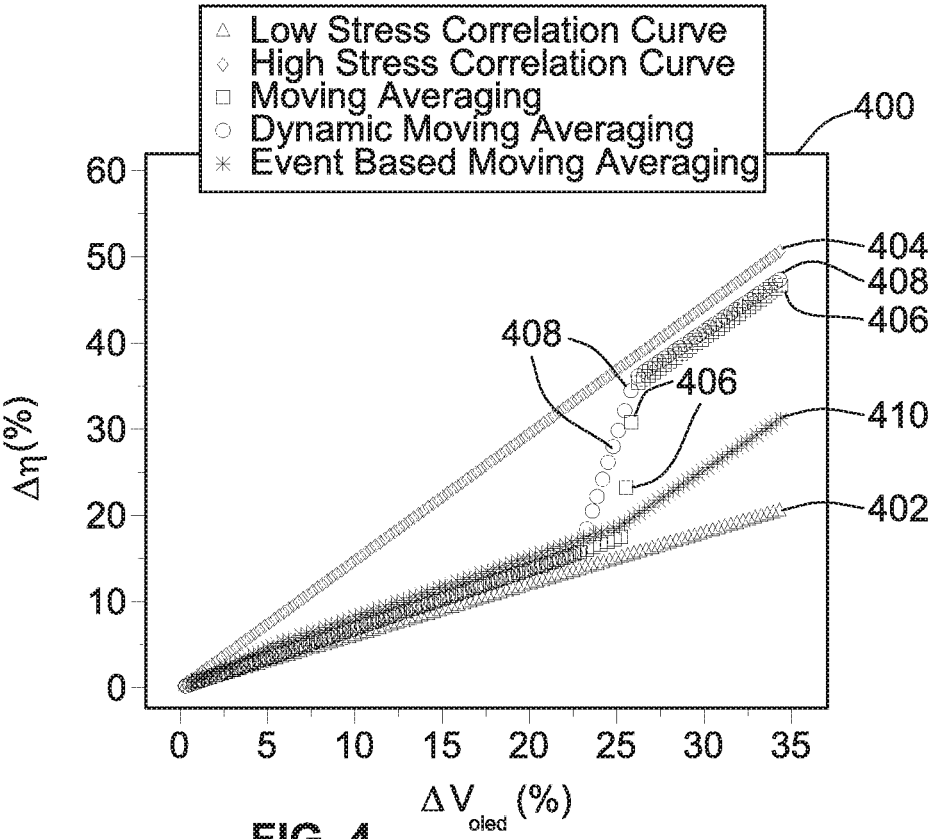
FIG. 4 is a graph of the plots of different characterization correlation curves and the results of techniques of using predetermined stress conditions to determine compensation.

FIG. 4 is a graph 400 showing the different characterization correlation curves based on the different techniques. The graph 400 compares the change in the optical compensation percent and the change in the voltage of the OLED of the active pixel required to produce a given current. As shown in the graph 400, a high stress predetermined characterization correlation curve 402 diverges from a low stress predetermined characterization correlation curve 404 at greater changes in voltage reflecting aging of an active pixel. A set of points 406 represents the correction curve determined by the moving average technique from the predetermined characterization correlation curves 402 and 404 for the current compensation of an active pixel at different changes in voltage. As the change in voltage increases reflecting aging, the transition of the correction curve 406 has a sharp transition between the low characterization correlation curve 404 and the high characterization correlation curve 402. A set of points 408 represents the characterization correlation curve determined by the dynamic moving averaging technique. A set of points 410 represents the compensation factors determined by the event-based moving averaging technique. Based on OLED behavior, one of the above techniques can be used to improve the compensation for OLED efficiency degradation.

As explained above, an electrical characteristic of a first set of sample pixels is measured. For example, the electrical characteristic of each of the first set of sample pixels can be measured by a thin film transistor (TFT) connected to each pixel. Alternatively, for example, an optical characteristic (e.g., luminance) can be measured by a photo sensor provided to each of the first set of sample pixels. The amount of change required in the brightness of each pixel can be extracted from the shift in voltage of one or more of the pixels. This may be implemented by a series of calculations to determine the correlation between shifts in the voltage or current supplied to a pixel and/or the brightness of the light-emitting material in that pixel.

The above described methods of extracting characteristic correlation curves for compensating aging of the pixels in the array may be performed by a processing device such as the controller 112 in FIG. 1 or another such device, which may be conveniently implemented using one or more general purpose computer systems, microprocessors, digital signal processors, micro-controllers, application specific integrated circuits (ASIC), programmable logic devices (PLD), field programmable logic devices (FPLD), field programmable gate arrays (FPGA) and the like, programmed according to the teachings as described and illustrated herein, as will be appreciated by those skilled in the computer, software, and networking arts.

In addition, two or more computing systems or devices may be substituted for any one of the controllers described herein. Accordingly, principles and advantages of distributed processing, such as redundancy, replication, and the like, also can be implemented, as desired, to increase the robustness and performance of controllers described herein.

The operation of the example characteristic correlation curves for compensating aging methods may be performed by machine readable instructions. In these examples, the machine readable instructions comprise an algorithm for execution by: (a) a processor, (b) a controller, and/or (c) one or more other suitable processing device(s). The algorithm may be embodied in software stored on tangible media such as, for example, a flash memory, a CD-ROM, a floppy disk, a hard drive, a digital video (versatile) disk (DVD), or other memory devices, but persons of ordinary skill in the art will readily appreciate that the entire algorithm and/or parts thereof could alternatively be executed by a device other than a processor and/or embodied in firmware or dedicated hardware in a well-known manner (e.g., it may be implemented by an application specific integrated circuit (ASIC), a programmable logic device (PLD), a field programmable logic device (FPLD), a field programmable gate array (FPGA), discrete logic, etc.). For example, any or all of the components of the characteristic correlation curves for compensating aging methods could be implemented by software, hardware, and/or firmware. Also, some or all of the machine readable instructions represented may be implemented manually.

Figure 5:
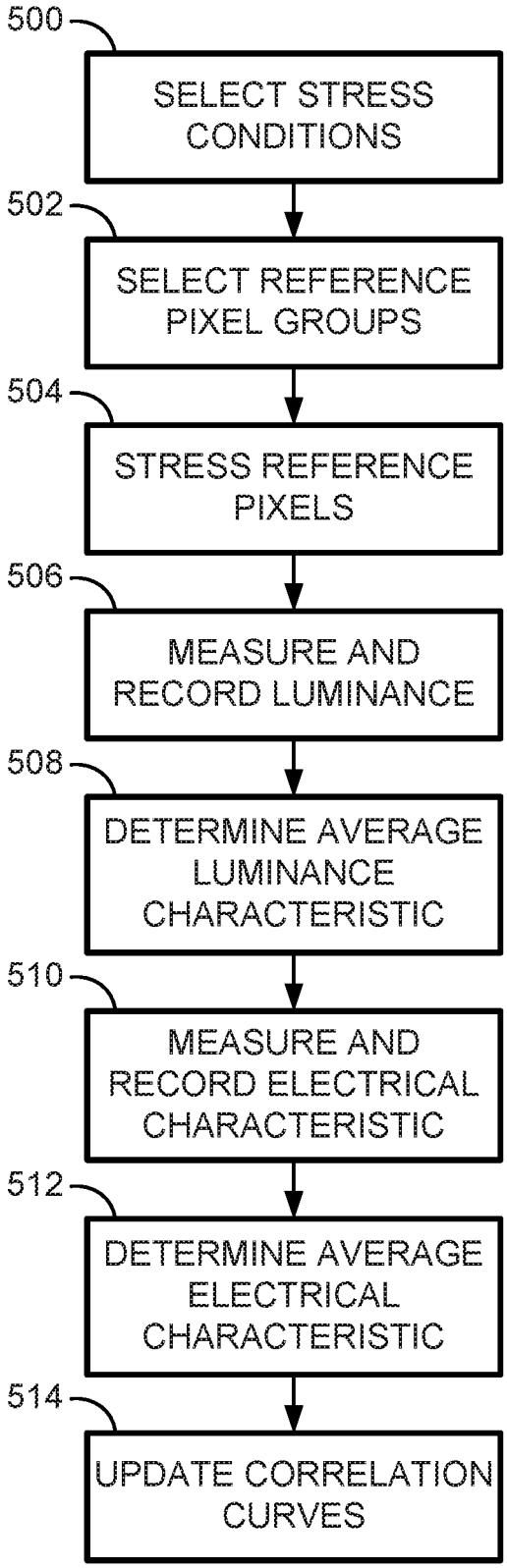
FIG. 5 is a flow diagram of the process of determining and updating characterization correlation curves based on groups of reference pixels under predetermined stress conditions.

FIG. 5 is a flow diagram of a process to determine and update the characterization correlation curves for a display system such as the display system 100 in FIG. 1. A selection of stress conditions is made to provide sufficient baselines for correlating the range of stress conditions for the active pixels (500). A group of reference pixels is then selected for each of the stress conditions (502). The reference pixels for each of the groups corresponding to each of the stress conditions are then stressed at the corresponding stress condition and base line optical and electrical characteristics are stored (504). At periodic intervals the luminance levels are measured and recorded for each pixel in each of the groups (506). The luminance characteristic is then determined by averaging the measured luminance for each pixel in the group of the pixels for each of the stress conditions (508). The electrical characteristics for each of the pixels in each of the groups are determined (510). The average of each pixel in the group is determined to determine the average electrical characteristic (512). The average luminance characteristic and the average electrical characteristic for each group are then used to update the characterization correlation curve for the corresponding predetermined stress condition (514). Once the correlation curves are determined and updated, the controller may use the updated characterization correlation curves to compensate for aging effects for active pixels subjected to different stress conditions.

Figure 6:
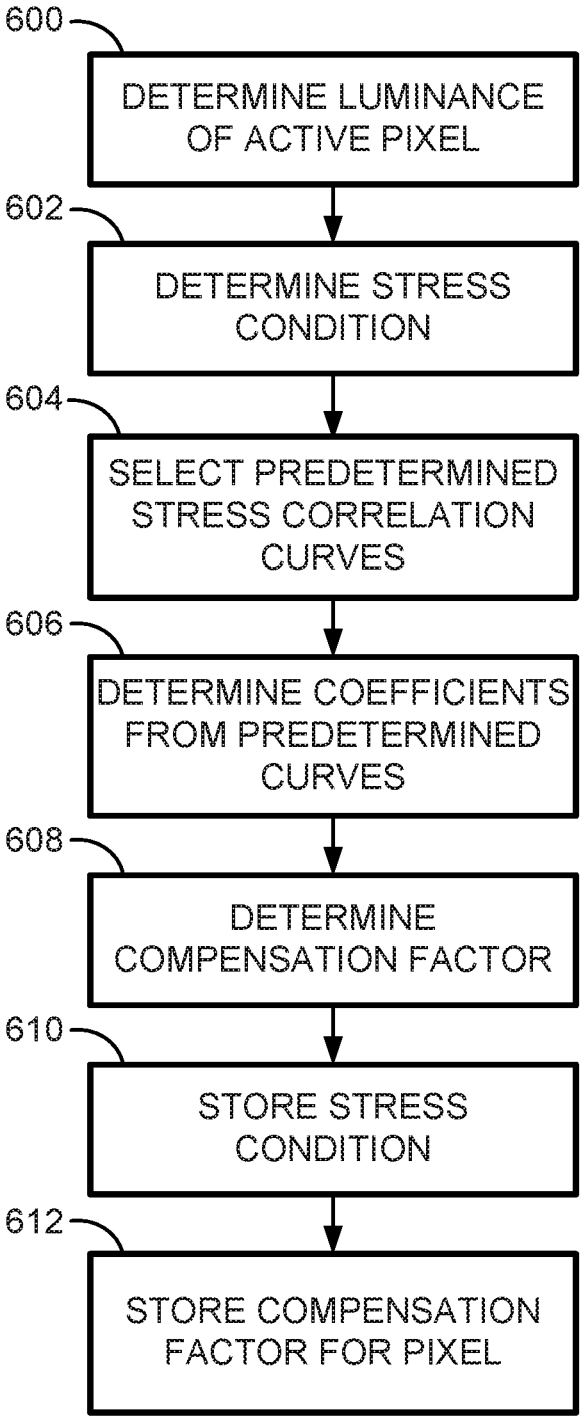
FIG. 6 is a flow diagram of the process of compensating the programming voltages of active pixels on a display using predetermined characterization correlation curves.

Referring to FIG. 6, a flowchart is illustrated for a process of using appropriate predetermined characterization correlation curves for a display system 100 as obtained in the process in FIG. 5 to determine the compensation factor for an active pixel at a given time. The luminance emitted by the active pixel is determined based on the highest luminance and the programming voltage (600). A stress condition is measured for a particular active pixel based on the previous stress condition, determined luminance, and the average compensation factor (602). The appropriate predetermined stress characterization correlation curves are read from memory (604). In this example, the two characterization correlation curves correspond to predetermined stress conditions that the measured stress condition of the active pixel falls between. The controller 112 then determines the coefficients from each of the predetermined stress conditions by using the measured current or voltage change from the active pixel (606). The controller then determines a modified coefficient to calculate a compensation voltage to add to the programming voltage to the active pixels (608). The determined stress condition is stored in the memory (610). The controller 112 then stores the new compensation factor, which may then be applied to modify the programming voltages to the active pixel during each frame period after the measurements of the reference pixels 130 (612).

Figure 7:
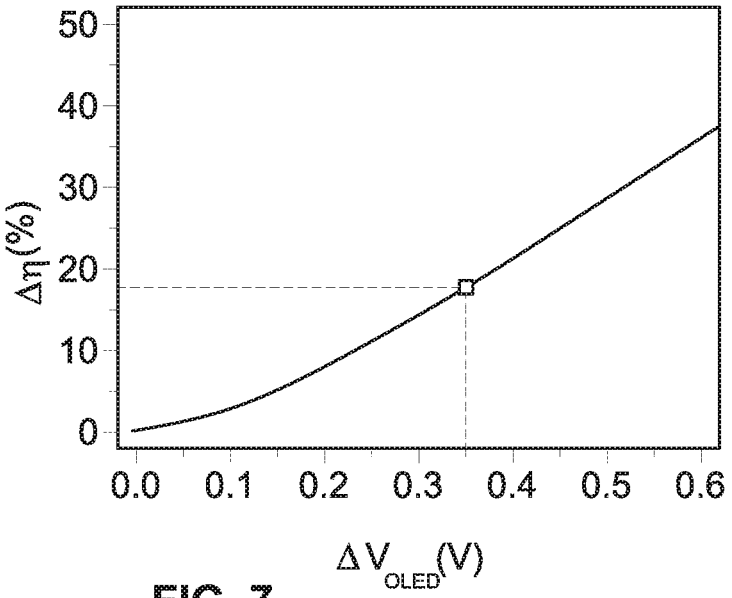
FIG. 7 is an interdependency curve of OLED efficiency degradation versus changes in OLED voltage.

OLED efficiency degradation can be calculated based on an interdependency curve based on OLED electrical changes versus efficiency degradation, such as the interdependency curve in FIG. 7. Here, the change in the OLED electrical parameter is detected, and that value is used to extract the efficiency degradation from the curve. The pixel current can then be adjusted accordingly to compensate for the degradation. The main challenge is that the interdependency curve is a function of stress conditions. Therefore, to achieve more accurate compensation, one needs to consider the effect of different stress conditions. One method is to use the stress condition of each pixel (or a group of pixels) to select from among different interdependency curves, to extract the proper efficiency lost for each specific case. Several methods of determining the stress condition will now be described.

Figure 8:
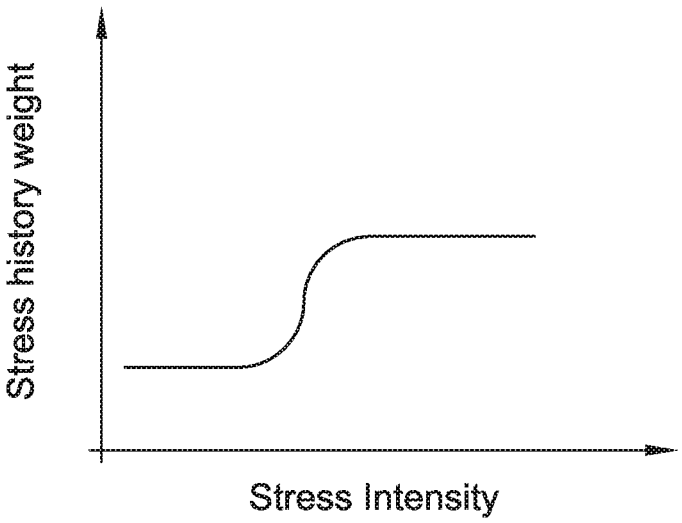
FIG. 8 is a graph of OLED stress history versus stress intensity.

First, one can create a stress history for each pixel (or group of pixels). The stress history can be simply a moving average of the stress conditions. To improve the calculation accuracy, a weighted stress history can be used. Here, the effect of each stress can have a different weight based on stress intensity or period, as in the example depicted in FIG. 8. For example, the effect of low intensity stress is less on selecting the OLED interdependency curve. Therefore, a curve that has lower weight for small intensity can be used, such as the curve in FIG. 8. Sub-sampling can also be used to calculate the stress history, to reduce the memory transfer activities. In one case, one can assume the stress history is low frequency in time. In this case, there is no need to sample the pixel conditions for every frame. The sampling rate can be modified for different applications based on content frame rate. Here, during every frame only a few pixels can be selected to obtain an updated stress history.

In another case, one can assume the stress history is low frequency in space. In this case, there is no need to sample all the pixels. Here, a sub-set of pixels are used to calculate the stress history, and then an interpolation technique can be used to calculate the stress history for all the pixels.

In another case, one can combine both low sampling rates in time and space.

Figure 9A:
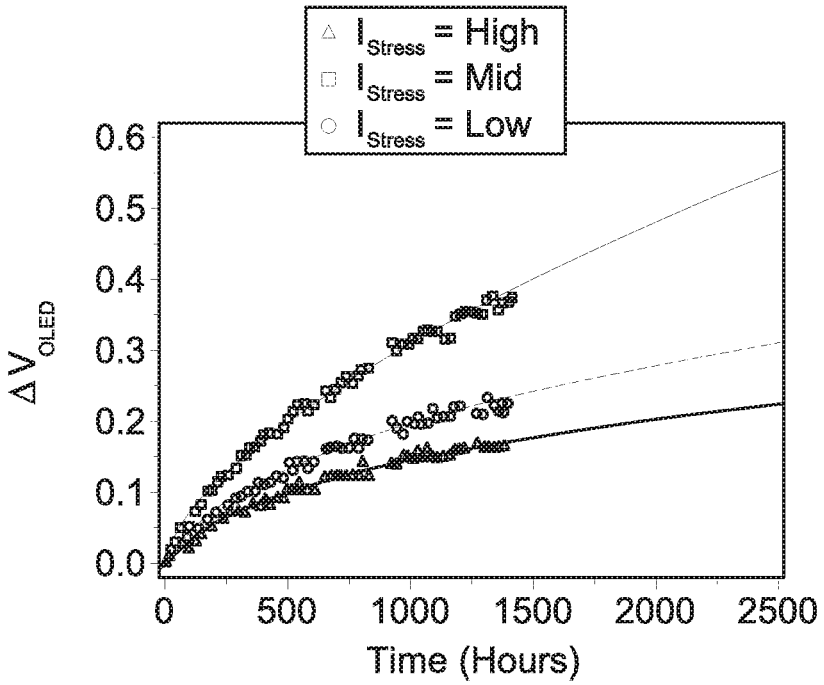
FIG. 9A is a graph of change in OLED voltage versus time for different stress conditions.
Figure 9B:
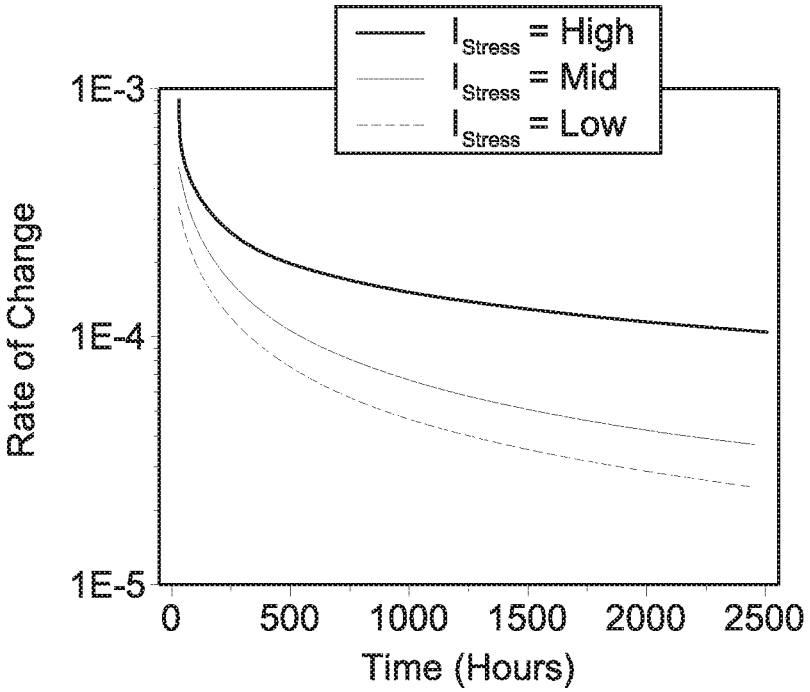
FIG. 9B is a graph of rate of change of OLED voltage versus time for different stress conditions.

In some cases, including the memory and calculation block required for stress history may not be possible. Here, the rate of change in the OLED electrical parameter can be used to extract the stress conditions, as depicted in FIGS. 9A and 9B. FIG. 9A illustrates the change of $\Delta V_{OLED}$ with time, for low, medium and high stress conditions, and FIG. 9B illustrates the rate of change versus time for the same three stress conditions.

Figure 10:
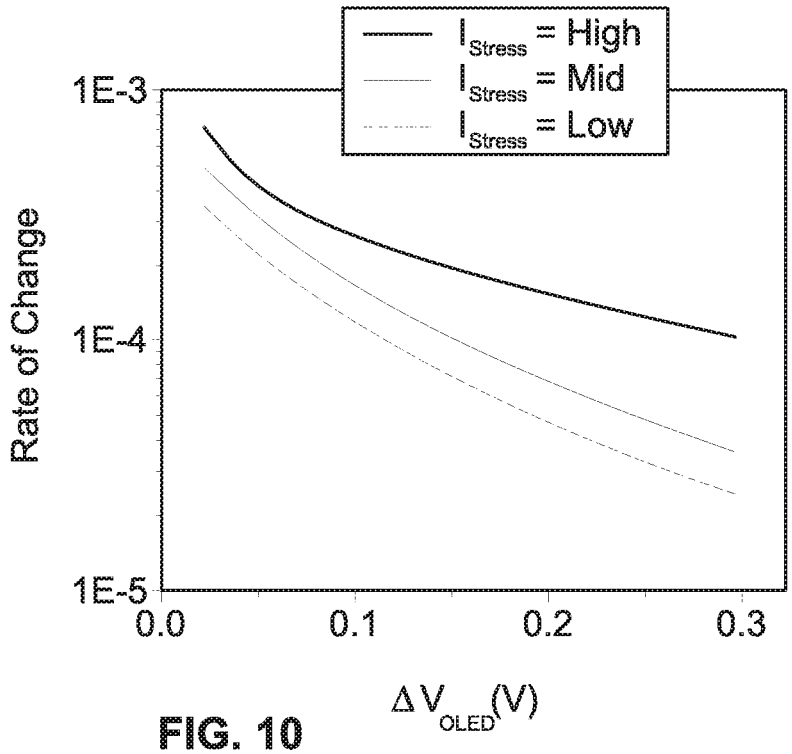
FIG. 10 is a graph of rate of change of OLED voltage versus change in OLED voltage, for different stress conditions.

As illustrated in FIG. 10, the rate of change in the electrical parameter can be used as an indicator of stress conditions. For example, the rate of change in the electrical parameter based on the change in the electrical parameter may be modeled or experimentally extracted for different stress conditions, as depicted in FIG. 10. The rate of change may also be used to extract the stress condition based on comparing the measured change and rate of change in the electrical parameter. Here, the function developed for change and rate of change of the electrical parameter is used. Alternatively, the stress condition, interdependency curves, and measured changed parameter may be used.

Figure 11:
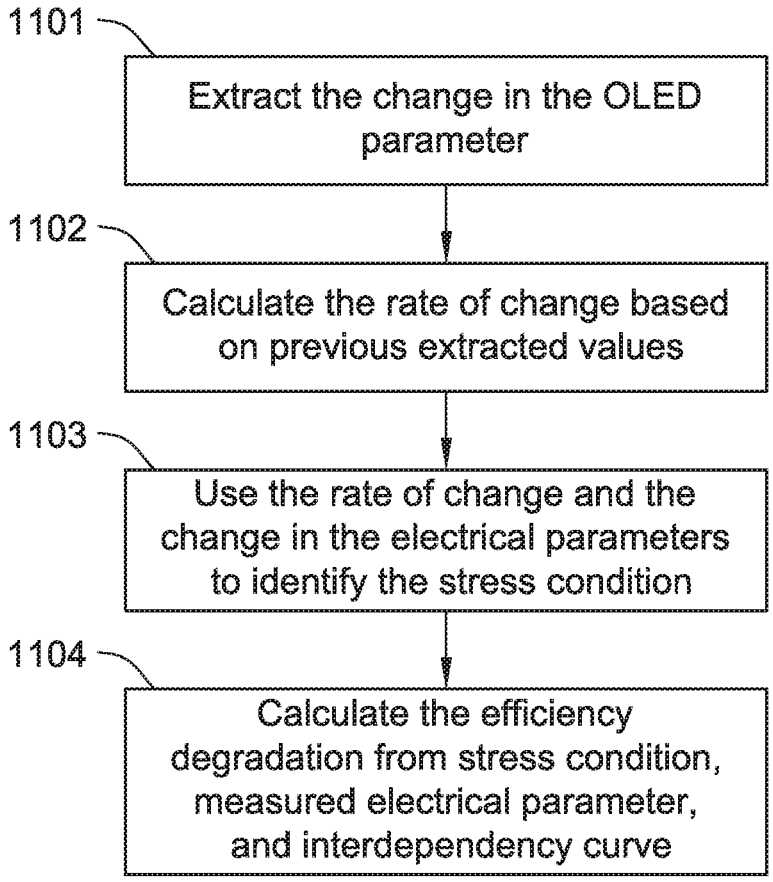
FIG. 11 is a flow chart of a procedure for extracting OLED efficiency degradation from changes in an OLED parameter such as OLED voltage.

FIG. 11 is a flow chart of a procedure for compensating the OLED efficiency degradation based on measuring the change and rate of change in the electrical parameter of the OLED. In this procedure, the change in the OLED parameter (e.g., OLED voltage) is extracted in step 1101, and then the rate of change in the OLED parameter, based on previously extracted values, is calculated in step 1102. Step 1103 then uses the rate of change and the change in the parameter to identify the stress condition. Finally, step 1104 calculates the efficiency degradation from the stress condition, the measured parameter, and interdependency curves.

Figure 12:
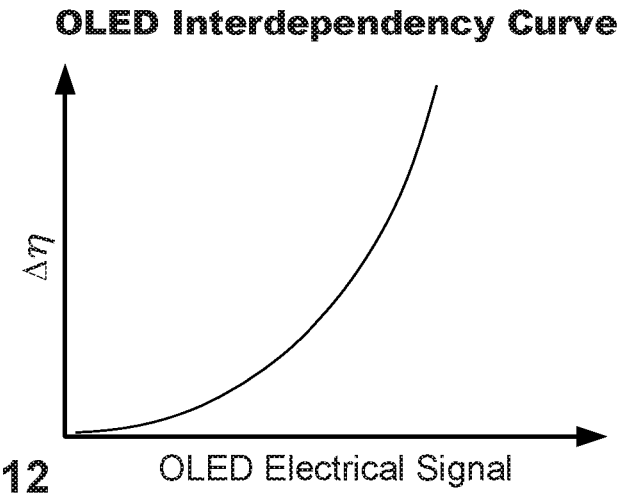
FIG. 12 is an OLED interdependency curve relating an OLED electrical signal and efficiency degradation.

One can compensate for OLED efficiency degradation using interdependency curves relating OLED electrical change (current or voltage) and efficiency degradation, as depicted in FIG. 12. Due to process variations, the interdependency curve may vary. In one example, a test OLED can be used in each display and the curve extracted for each display after fabrication or during the display operation. In the case of smaller displays, the test OLED devices can be put on the substrates and used to extract the curves after fabrication.

Figure 13:
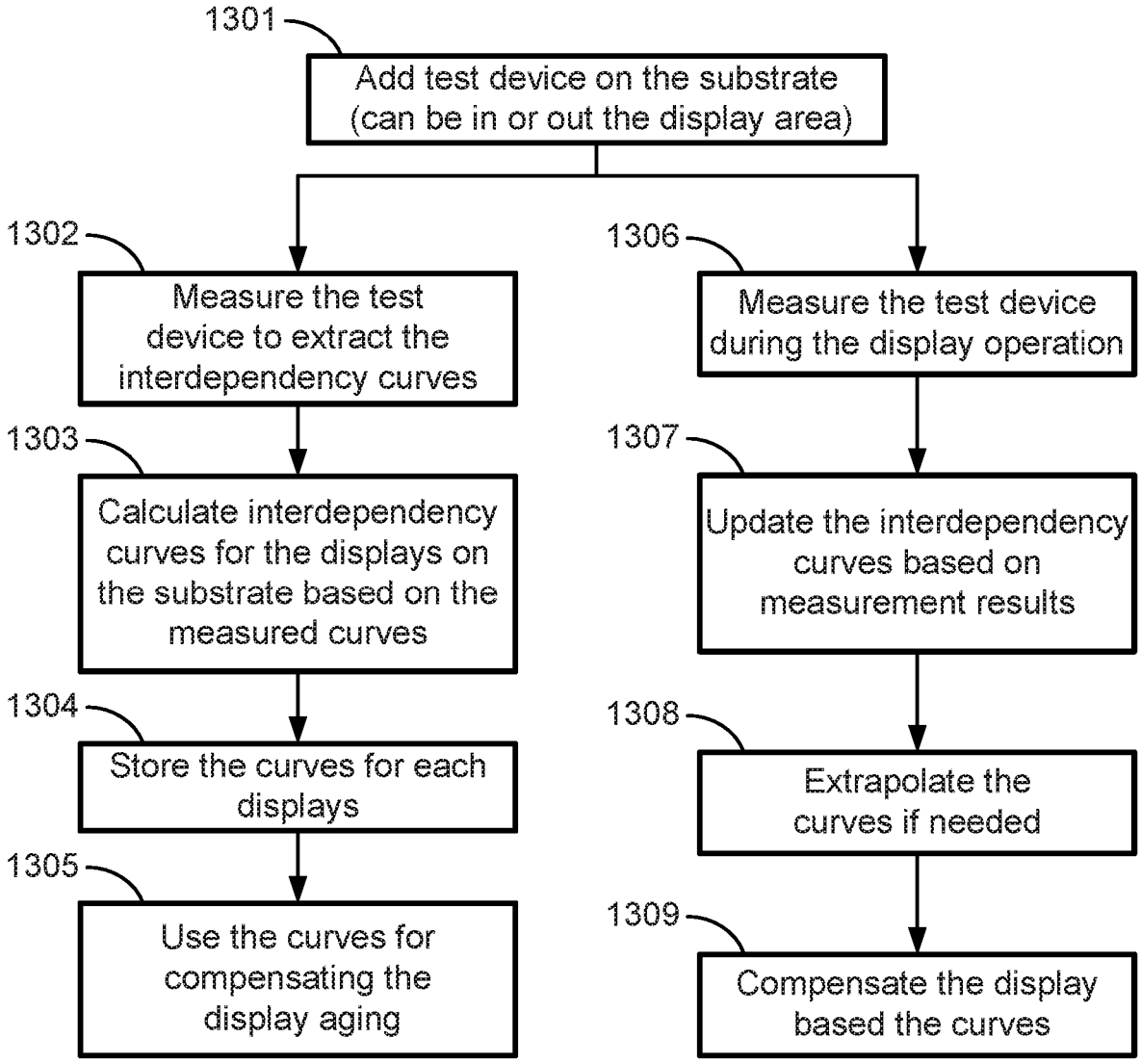
FIG. 13 is a flow chart of a procedure for extracting interdependency curves from test devices.

FIG. 13 is a flow chart of a process for extracting the interdependency curves from the test devices, either off line or during the display operation, or a combination of both. In this case, the curves extracted in the factory are stored for aging compensation. During the display operation, the curve can be updated with additional data based on measurement results of the test device in the display. However, since extraction may take time, a set of curves may measured in advance and put in the library. Here, the test devices are aged at predetermined aging levels (generally higher than normal) to extract some aging behavior in a short time period (and/or their current-voltage-luminance, IVL, is measured). After that, the extracted aging behavior is used to find a proper curve, having a similar or close aging behavior, from the library of curves.

In FIG. 13, the first step 1301 adds the test device on the substrate, in or out of the display area. Then step 1302 measures the test device to extract the interdependency curves. Step 1303 calculates the interdependency curves for the displays on the substrate, based on the measured curves. The curves are stored for each display in step 1304, and then used for compensating the display aging in step 1305. Alternatively, the test devices can be measured during the display operation at step 1306. Step 1307 then updates the interdependence curves based on the measured results. Step 1308 extrapolates the curves if needed, and step 1309 compensates the display based on the curves.

The following are some examples of procedures for finding a proper curve from a library:

(1) Choose the one with closest aging behavior (and/or IVL characteristic).

(2) Use the samples in the library with the closer behavior to the test sample and create a curve for the display. Here, weighted averaging can be used in which the weight of each curve is determined based on the error between their aging behaviors.

(3) If the error between the closet set of curves in the library and the test device is higher than a predetermined threshold, the test device can be used to create new curves and add them to the library.

Figure 14:
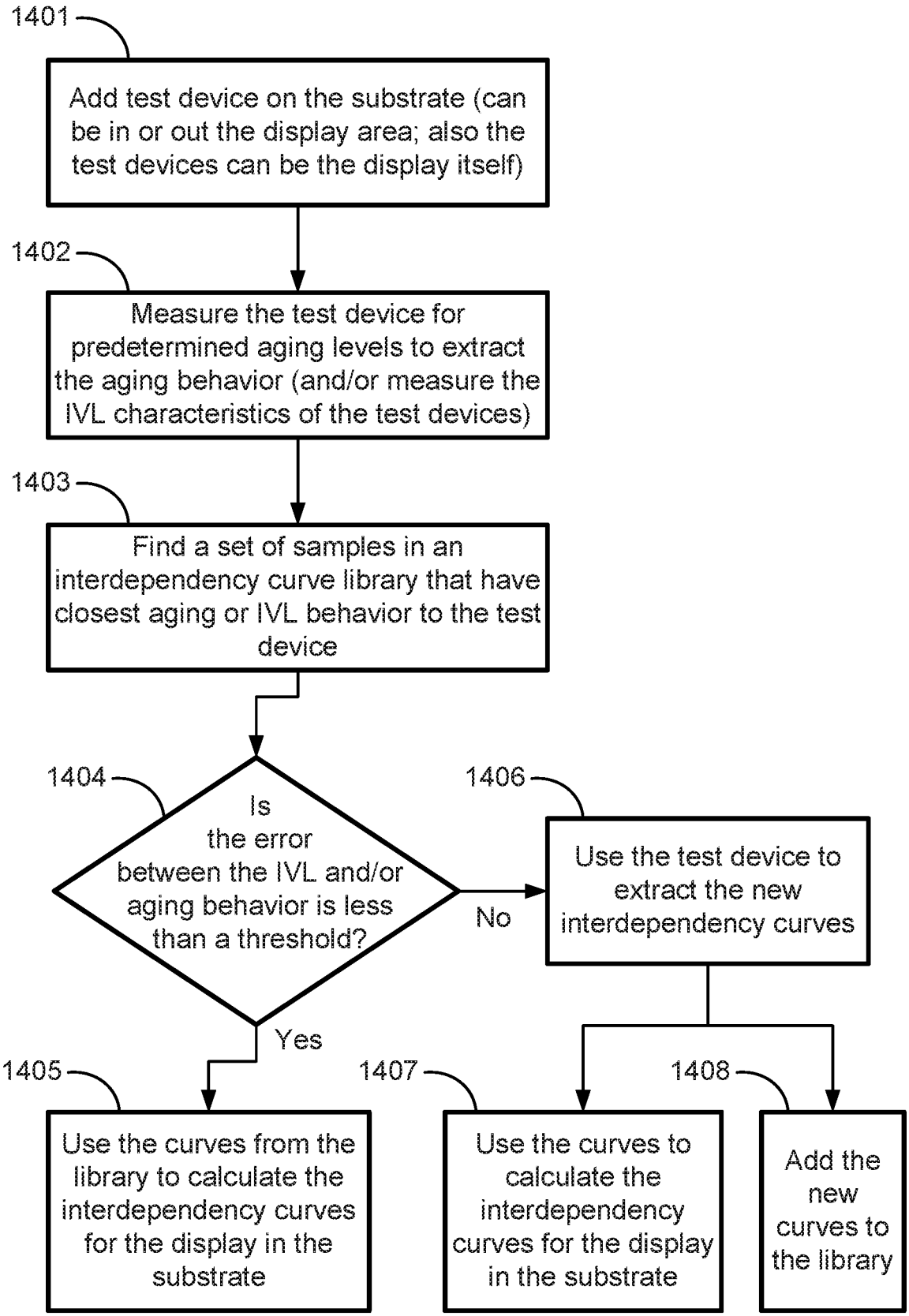
FIG. 14 is a flow chart of a procedure for calculating interdependency curves from a library.

FIG. 14 is a flow chart of a procedure for addressing the process variation between substrates or within a substrate. The first step 1401 adds a test device on the substrate, either in or out of the display area, or the test device can be the display itself. Step 1402 then measures the test device for predetermined aging levels to extract the aging behavior and/or measures the IVL characteristics of the test devices. Step 1403 finds a set of samples in an interdependency curve library that have the closest aging or IVL behavior to the test device. Then step 1404 determines whether the error between the IVL and/or aging behavior is less than a threshold. If the answer is affirmative, step 1405 uses the curves from the library to calculate the interdependency curves for the display in the substrate. If the answer at step 1404 is negative, step 1406 uses the test device to extract the new interdependency curves. Then the curves are used to calculate the interdependency curves for the display in the substrate in step 1407, and step 1408 adds the new curves to the library.

Semiconductor devices (e.g., OLEDs) may age differently under different ambient conditions (e.g., temperature, illumination, etc.) in addition to stress conditions. Moreover, some rare stress conditions may push the devices into aging conditions that are different from normal conditions. For example, an extremely high stress condition may damage the device physically (e.g., affecting contacts or other layers). In this case, identifying a compensation curve may require additional information, which can be obtained from the other devices in the pixel (e.g., transistors or sensors), from rates of change in the device characteristics (e.g., threshold voltage shift or mobility change), or by using the change in a multiple-device parameter to identify the stress conditions. In the case of using other devices, the rate of change in the other device parameters and/or the rate (or the absolute value) of change in the other-device parameter compared with the rate (or the absolute value) of change in the device parameter can be used to identify the aging condition. For example, at higher temperature, the TFT and the OLED become faster and so the rate of change can be an indicator of the temperature variation at which a TFT or an OLED is aged.

Figure 15B:
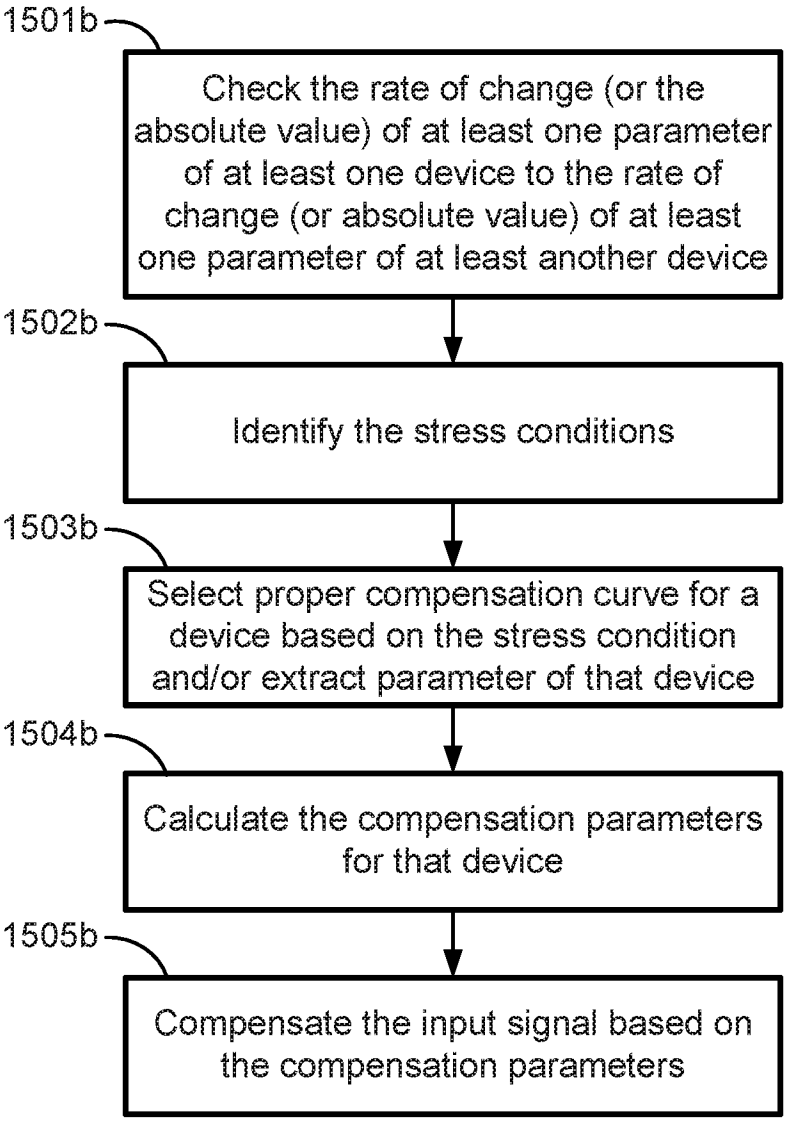
FIGS. 15A and 15B are flow charts of procedures for identifying the stress condition of a device based on the rate of change or absolute value of a parameter of the device or another device.
Figure 15A:
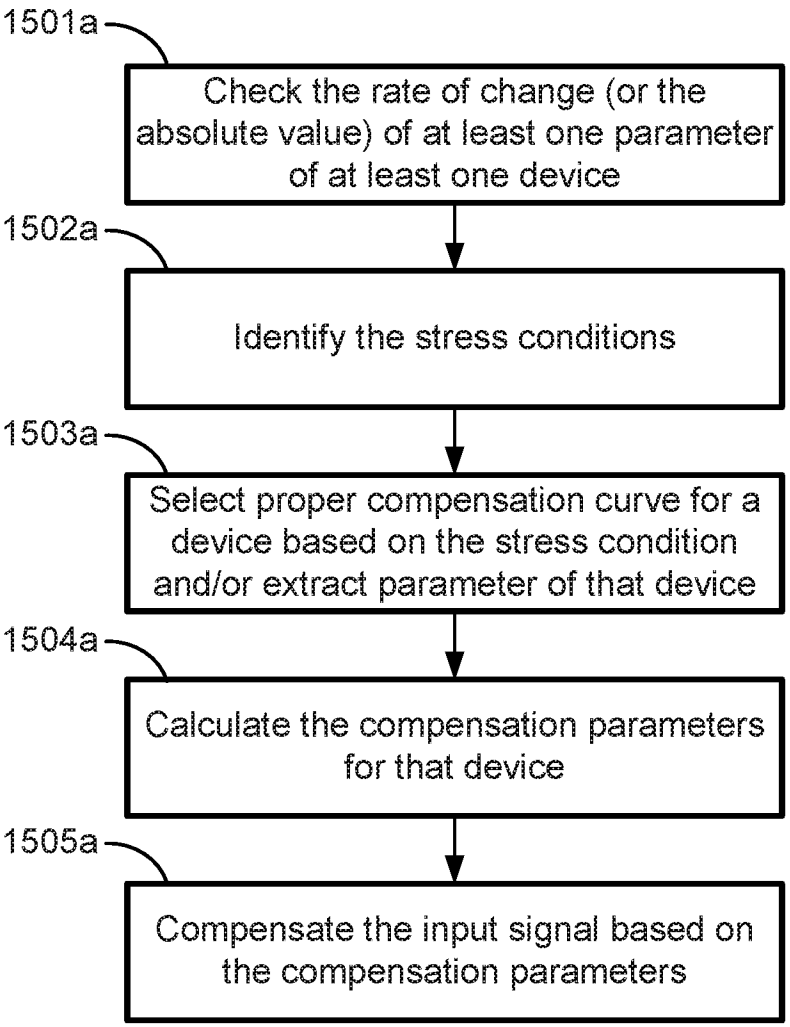

FIGS. 15A and 15B are flow charts that illustrate procedures for identifying the stress conditions for a device based on either the rate of change or absolute value of at least one parameter of at least one device, or on a comparison of the rate of change or absolute value of at least one parameter of at least one device to the rate of change or absolute value of at least one parameter of at least one other device. The identified stress conditions are used to select a proper compensation curve based on the identified stress conditions and/or extract a parameter of the device. The selected compensation curve is used to calculate compensation parameters for the device, and the input signal is compensated based on the calculated compensation parameters.

In FIG. 15A, the first step 1501*a* checks the rate of change or absolute value of at least one parameter of at least one device, such as an OLED, and then step 1502*a* identifies the stress conditions from that rate of change or absolute value. Step 1503*a* then selects the proper compensation curve for a device based on an identified stress condition and/or extracts a parameter of that device. The selected compensation curve is used at step 1504*a* to calculate compensation parameters for that device, and then step 1505*a* compensates the input signal based on the calculated compensation parameters.

In FIG. 15B, the first step 1501*b* compares the rate of change or absolute value of at least one parameter of at least one device, such as an OLED, to the rate of change or absolute value of at least one parameter of at least one other device. Step 1502*b* then identifies the stress conditions from that comparison, and step 1503*b* selects the proper compensation curve for a device based on an identified stress condition and/or extracts a parameter of that device. The selected compensation curve is used at step 1504*b* to calculate compensation parameters for that device, and then step 1505*b* compensates the input signal based on the calculated compensation parameters.

Figure 16:
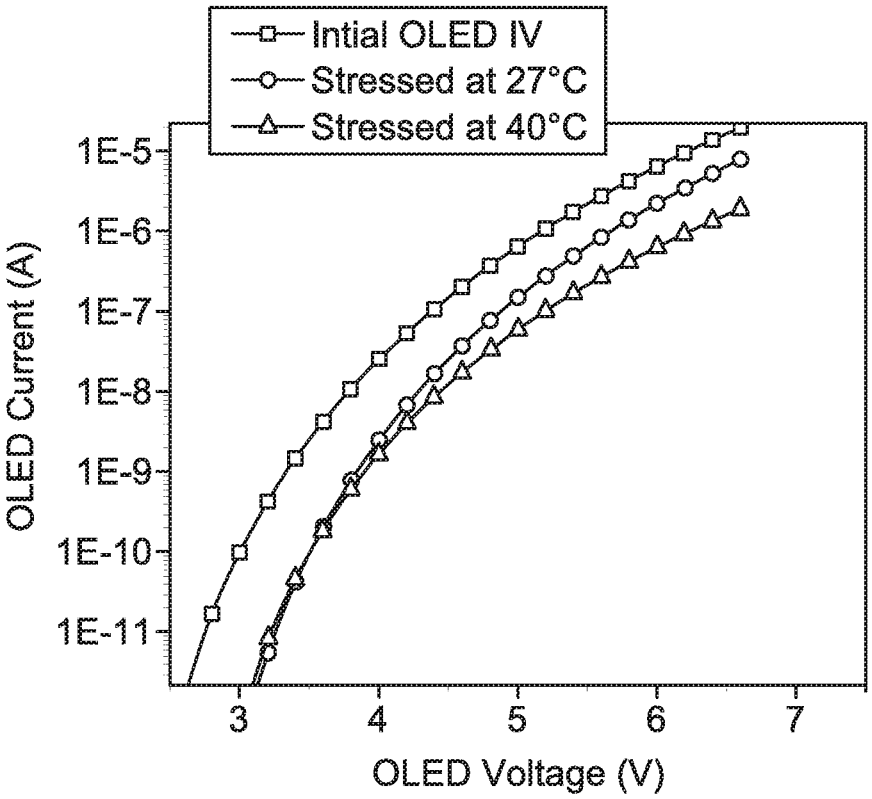
FIG. 16 is an example of the IV characteristic of an OLED subjected to three different stress conditions.

In another embodiment, one can look at the rates of change in different parameters in one device to identify the stress condition. For example, in the case of an OLED, the shift in voltage (or current) at different current levels (or voltage levels) can identify the stress conditions. FIG. 16 is an example of the IV characteristics of an OLED for three different conditions, namely, initial condition, stressed at 27° C., and stressed at 40° C. It can be seen that the characteristics change significantly as the stress conditions change.

Figure 17:
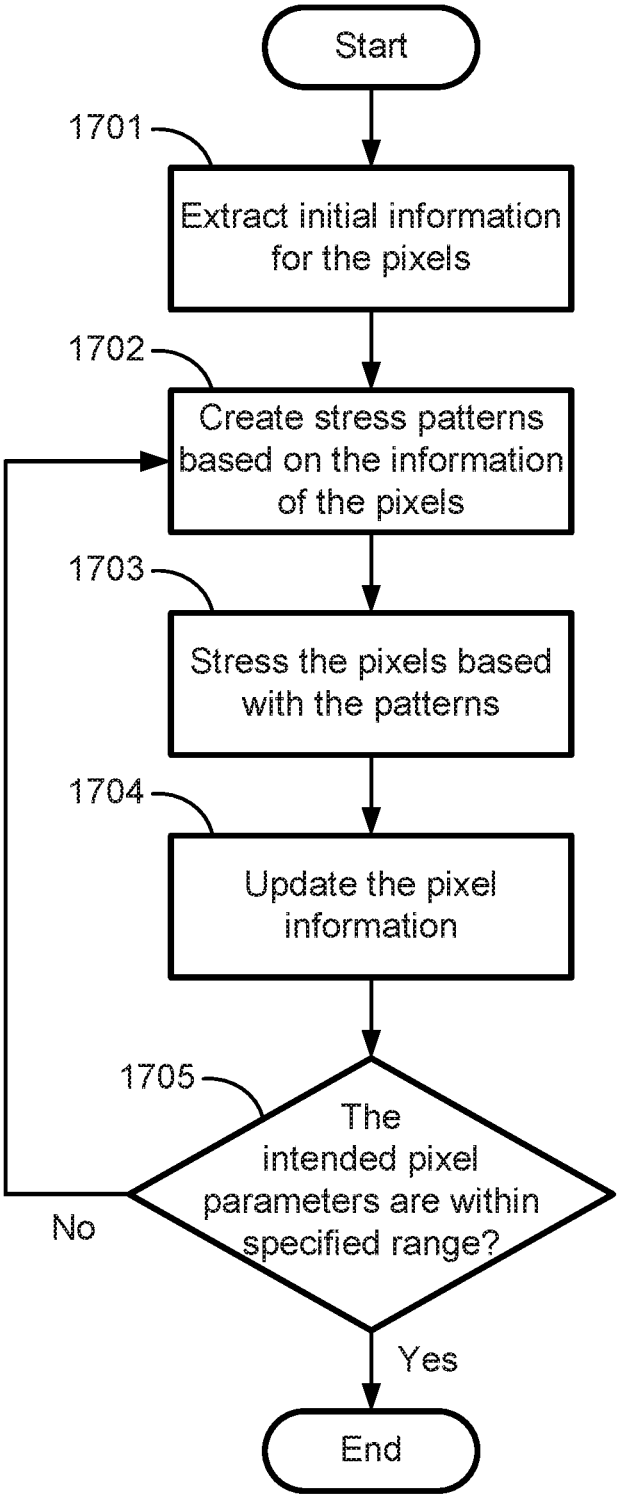
FIG. 17 is a flow chart of a procedure for achieving initial equalization of pixels in an emissive display.
Figure 18:
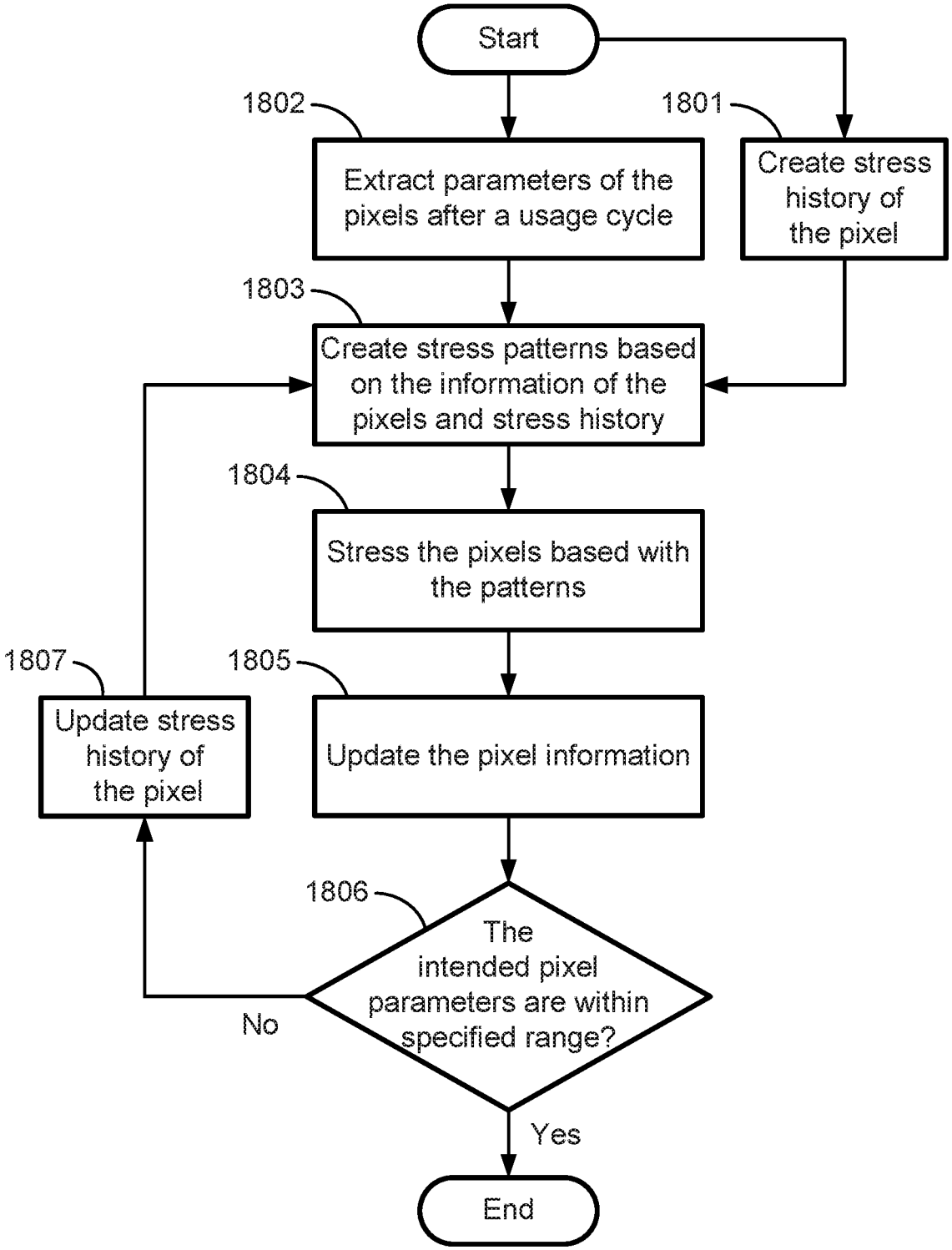
FIG. 18 is a flow chart of a procedure for achieving equalization of pixels in an emissive display after a usage cycle.

FIGS. 17 and 18 are flow charts of procedures for equalizing pixels in an emissive display panel having an array of pixels that include semiconductor devices that age under different ambient and stress conditions. FIG. 17 illustrates a procedure for achieving initial equalization of the pixels, and FIG. 18 illustrates a procedure for equalizing the pixels after a usage cycle.

In the procedure illustrated in FIG. 17, at least one pixel parameter (pixel information) is extracted from the emissive display panel at step 1701. These parameters are used to create stress patterns for the panel at step 1702. The stress patterns are applied to the panel at step 1703, and the pixel parameters are monitored and updated at step 1704 by extracting the pixel parameter from the stressed pixels. Step 1705 determines whether the pixel parameters extracted from the stressed pixels is within a preselected range, and if the answer is negative, steps 1702-1705 are repeated. This process continues until step 1705 produces a positive answer, which means that the pixel parameters extracted from the stressed pixels are within the preselected range, and thus the pixels are returned to normal operation.

The stress pattern can include duration and stress level. In one embodiment of the invention, the pixel parameters are monitored in-line during the stress to assure the parameters of the pixels do not pass the specified range. In another embodiment of the invention, the parameters of selected pixels or some reference pixels are monitored in-line during stress. In another embodiment of the invention, the pixels are stressed for a period of time and then the pixel parameters are extracted. After that the pixel parameters are updated and the stress pattern and timing can be updated with new data including new pixel parameters and the rate of change. For example, if the rate of change is fast, the stress intervals can be smaller to avoid passing the specified ranges for pixel parameters.

The setting for the parameters of the pixels can be variation between the parameters across the panel. In another embodiment it can be specific value.

In one example, the pixel information (or parameter) can be the threshold voltage of the drive TFT. Here, the stress condition of each pixel is defined based on its threshold voltage. In another example, the pixel parameter can be the voltage of the emissive devices (or the brightness uniformity).

The pixel information can be extracted through different means. One method can be through a power supply. In another case, the pixel parameters can be extracted through a monitor line.

In FIG. 18, the pixel parameters are extracted after a usage cycle. For example, the extraction can be triggered by a user, by a timer, or by a specific operating condition (e.g., being in charging mode). The stress history of the pixels is created during the usage cycle at step 1801, and the pixel parameters are extracted after the usage cycle at step 1801. The stress history can include the stress level during the operation and the stress time. In another embodiment, the stress history can be the average stress condition of the pixel during the usage cycle.

Based on the extracted pixel parameters and the stress history, stress patterns are generated at step 1803. Then the pixels are stressed at step 1804, in accordance with the generated stress pattern. The parameters of the stressed pixels are monitored and updated at step 1805 by extracting the pixel parameter from the stressed pixels. Step 1806 determines whether the pixel parameters extracted from the stressed pixels is within a preselected range, and if the answer is negative, step 1807 updates the stress history of the pixels, and then steps 1803-1806 are repeated. This process continues until step 1806 produces a positive answer, which means that the pixel parameters extracted from the stressed pixels are within the preselected range, and thus the pixels are returned to normal operation.

In one example, the pixels are assigned to different categories based on the stress history, and then the pixels are stressed with all the other categories that they are not assigned to. At the same time, the pixel parameters are monitored similar to the previous case to assure they do not pass the specified ranges.

In another example, the stress history has no timing information, and the change in pixel parameters can be used to identify the stress level and timing. For example, in one case, shift in the electrical characteristics of the emissive device can be used to extract the stress condition of each pixel for the stress pattern.

In yet another embodiment, the interdependency curves between pixel parameters and its optical performance can be used to extract the stress condition for each pixel. In the case of electrical characteristics of the emissive device, the interdependency curves can be used to find the worst case of efficiency degradation. Then, the delta efficiency between each pixel and the worst case can be determined. After that, the corresponding change in electrical characteristics of the emissive device of each pixel can be calculated to minimize the difference in efficiency between the pixel and the worst case. Then the pixels are stressed, and their pixel parameters (e.g., electrical characteristics of the emissive device) are monitored to reach the calculated shift. Similar operations can be used for other pixel parameters as well.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

The invention claimed is:

1. A method of equalizing pixel circuits in an array of pixel circuits that include semiconductor devices that age differently under different ambient and stress conditions, said method comprising a) creating a stress history of said pixel circuits during a usage cycle using a controller, said stress history comprising data for tracking a history of stress said pixel circuits have been subjected to;

b) extracting a pixel parameter from said array during or after the usage cycle using at least one of a voltage sensor, a current sensor, and a photo sensor;

c) updating a stress pattern for said array using the controller, based on the extracted pixel parameter and the stress history;

d) stressing said pixel circuits in accordance with said stress pattern;

e) extracting said pixel parameter from the stressed pixel circuits using at least one of the voltage sensor, the current sensor, and the photo sensor;

f) determining that the pixel parameter extracted from the stressed pixel circuits is not within a preselected range using the controller and updating the stress history; and g) after repeating steps c) to f) a number of times while the pixel parameter is not within the preselected range, repeating steps c) to e) once and thereafter determining that the pixel parameter extracted from the stressed pixel circuits is within the preselected range and returning said array of pixel circuits to normal operation.

2. The method according to claim 1, wherein the pixel parameter comprises threshold voltage of a drive transistor in each active pixel circuit.

3. The method according to claim 1, wherein the pixel parameter comprises luminance level.

4. The method according to claim 1, wherein the pixel parameter comprises current output of each pixel circuit.

5. The method according to claim 1, wherein the pixel parameter comprises a variation between the pixel parameter across the array of pixel circuits.

6. The method according to claim 1, wherein step d) comprises applying stress to said pixel circuits using a current supply.

7. The method according to claim 1, wherein the stress history includes stress time and stress level.

8. The method according to claim 1, wherein the stress history includes average stress condition of each pixel circuit during the usage cycle.

9. The method according to claim 1, wherein step e) is conducted at the same time as step d).

10. The method according to claim 1, wherein step e) is conducted after step d).

11. A system for equalizing the pixel circuits in an array of pixel circuits, said system comprising a plurality of active pixel circuits for displaying an image, the active pixel circuits each including semiconductor devices that age differently under different ambient and stress conditions a controller coupled to said array of pixel circuits and configured to:

a) create a stress history of said pixel circuits during or after a usage cycle, said stress history comprising data for tracking a history of stress said pixel circuits have been subjected to;

b) control extraction of a pixel parameter from said array after the usage cycle;

c) update a stress pattern for said array, based on the extracted pixel parameter and the stress history;

d) control application of stress to said pixel circuits in accordance with said stress pattern;

e) control extraction of said pixel parameter from the stressed pixel circuits;

f) determine whether the pixel parameter extracted from the stressed pixel circuits is within a preselected range; and when the pixel parameter is not within the preselected range:

updating the stress history, and repeating steps c) to f)

when the pixel parameter is within the preselected range, return said array of pixel circuits to normal operation.

12. The system according to claim 11, wherein the pixel parameter comprises threshold voltage of a drive transistor in each active pixel circuit; and further comprising a voltage sensor for extraction of the threshold voltage.

13. The system according to claim 11, wherein the pixel parameter comprises luminance level; and further comprising at least one photo sensor for extraction of the luminance level of each pixel circuit.

14. The system according to claim 11, wherein the pixel parameter comprises current output of the pixel circuit; and further comprising at least one current sensor for extraction of the current output.

15. The system according to claim 11, wherein the pixel parameter comprises a variation between the pixel parameter across the array of pixel circuits.

16. The system according to claim 11, further comprising a current supply and readout circuit for applying stress to said pixel circuits.

17. The system according to claim 11, wherein the stress history includes stress time and stress level.

18. The system according to claim 11, wherein the stress history includes average stress condition of each pixel circuit during the usage cycle.

19. The system according to claim 11, wherein step e) is conducted at the same time as step d).

20. The system according to claim 11, wherein step e) is conducted after step d).

* * * * *